US010386130B2

(12) United States Patent
Eckert et al.

(10) Patent No.: US 10,386,130 B2
(45) Date of Patent: Aug. 20, 2019

(54) FLOW DEVICES AND METHODS FOR GUIDING FLUID FLOW

(71) Applicant: DUERR CYPLAN LTD., Aldermaston, Reading, Berkshire (GB)

(72) Inventors: Frank Eckert, Bad Lobenstein (DE); Fabian Trefz, Auenwald (DE); Timm Greschner, Leinfelden-Echterdingen (DE)

(73) Assignee: DUERR CYPLAN LTD., Aldermaston (GB)

( * ) Notice: Subject to any disclaimer, the term of this patent is extended or adjusted under 35 U.S.C. 154(b) by 179 days.

(21) Appl. No.: 15/217,675

(22) Filed: Jul. 22, 2016

(65) Prior Publication Data

US 2016/0334175 A1 Nov. 17, 2016

Related U.S. Application Data

(63) Continuation-in-part of application No. PCT/EP2015/051960, filed on Jan. 30, 2015.

(30) Foreign Application Priority Data

Feb. 3, 2014 (DE) ..... 10 2014 201 908

(51) Int. Cl.
*F28F 9/26* (2006.01)
*F28D 7/10* (2006.01)
(Continued)

(52) U.S. Cl.
CPC ..... *F28F 9/26* (2013.01); *F28D 7/06* (2013.01); *F28D 7/103* (2013.01); *F28D 7/1607* (2013.01);
(Continued)

(58) Field of Classification Search
CPC .... F28F 9/22; F28F 9/26; F28F 9/0265; F28F 9/028; F28F 9/0131; F28F 1/003;
(Continued)

(56) References Cited

U.S. PATENT DOCUMENTS 2,060,936 A * 11/1936 Haag Joseph, Jr. .... F28D 7/026 137/340
3,087,253 A * 4/1963 Wulf ..... F28D 13/00 159/4.06
(Continued)

FOREIGN PATENT DOCUMENTS

CA 2513989 6/2006
CA 2858863 A1 * 6/2013 ..... F28D 7/024
(Continued)

OTHER PUBLICATIONS

DE 102010037206 A1—English Machine Translation—Retrieved Jul. 2018.*
(Continued)

*Primary Examiner* — Cassey D Bauer
*Assistant Examiner* — Jenna M Hopkins
(74) *Attorney, Agent, or Firm* — Hanley, Flight and Zimmerman, LLC

(57) ABSTRACT

Flow devices and a methods for guiding flow are disclosed. The examples disclosed herein relate to a flow device (50) including a first line system (60) for conducting a first fluid flow (100), wherein the first line system (60) comprises a guide pipe (21) and at least one guide means (20, 22) influencing a flow direction of the fluid flow (100) such that the fluid flow (100) between an inflow region (61*b*) and an outflow region (62*b*) of the first line system (60) in a circulation-flow region (105) at a circumferential angle UW circulates in a radially encircling manner about an inflow axis (102) and/or an outflow axis (103). The examples
(Continued)

disclosed herein furthermore relate to a method for guiding a fluid stream (10) which has an inflow portion (12) and an outflow portion (13) having substantially parallel, preferably coaxial inflow and outflow axes (14, 15). It is proposed that the fluid stream (10) by way of at least one guide means (20), which is disposed between the inflow portion (12) and the outflow portion (13) in a circulation-flow portion (17) at a circumferential angle UW, is deflected in a radially encircling manner about the inflow axis (14) and the outflow axis (15), wherein the circumferential angle UW is greater than 0°.

26 Claims, 14 Drawing Sheets

(51) Int. Cl.

| | |
|---|---|
| ***F28F 9/013*** | (2006.01) |
| ***F28F 9/02*** | (2006.01) |
| ***F28F 9/22*** | (2006.01) |
| ***F28F 27/02*** | (2006.01) |
| ***F28D 7/06*** | (2006.01) |
| ***F28D 7/16*** | (2006.01) |
| ***F28F 1/00*** | (2006.01) |

(52) U.S. Cl.
CPC ..... *F28F 1/003* (2013.01); *F28F 9/0131* (2013.01); *F28F 9/028* (2013.01); *F28F 9/0265* (2013.01); *F28F 9/22* (2013.01); *F28F 27/02* (2013.01); *F28F 2009/222* (2013.01)

(58) Field of Classification Search
CPC .. F28F 27/02; F28D 7/103; F28D 7/06; F28D 7/1607
USPC ..... 165/177, 155
See application file for complete search history.

(56) References Cited

U.S. PATENT DOCUMENTS

| | | | | | |
|---|---|---|---|---|---|
| 3,326,280 | A * | 6/1967 | Grenier | F22B 1/021 | 159/17.4 |
| 3,649,215 | A * | 3/1972 | Perga | B01D 53/944 | 422/176 |
| 3,822,741 | A * | 7/1974 | Lippitsch | F28F 9/00 | 165/158 |
| 4,090,558 | A * | 5/1978 | Akama | F23L 15/04 | 165/135 |
| 4,142,578 | A * | 3/1979 | Smith | F28F 9/22 | 165/134.1 |
| 4,361,009 | A * | 11/1982 | Schluderberg | F01K 3/00 | 165/104.15 |
| 4,361,206 | A * | 11/1982 | Tsai | F01N 1/08 | 181/255 |
| 4,614,105 | A * | 9/1986 | Hisao | B21D 5/02 | 29/727 |
| 4,778,005 | A * | 10/1988 | Smith | F28D 7/06 | 165/160 |
| 5,145,255 | A * | 9/1992 | Shimada | B01F 7/0025 | 366/295 |
| 5,544,700 | A * | 8/1996 | Shagoury | F02C 7/14 | 165/139 |
| 5,820,641 | A * | 10/1998 | Gu | B01D 5/0006 | 55/434.4 |
| 5,832,991 | A * | 11/1998 | Cesaroni | F28F 9/22 | 165/160 |
| 6,460,614 | B1 * | 10/2002 | Hamert | B01J 19/0013 | 165/170 |
| 6,510,819 | B1 | 1/2003 | Pollock et al. | | |
| 6,756,023 | B1 * | 6/2004 | Corr | B01J 8/067 | 422/198 |
| 6,827,138 | B1 * | 12/2004 | Master | F28D 7/1607 | 165/159 |
| 7,740,057 | B2 * | 6/2010 | Wang | F28D 7/1607 | 165/159 |
| 8,522,537 | B2 * | 9/2013 | Lee | F01M 5/001 | 60/298 |
| 9,140,146 | B2 * | 9/2015 | Hartmann | F01K 23/10 | |
| 2001/0040024 | A1 * | 11/2001 | Blanda, Jr. | C01C 3/022 | 165/134.1 |
| 2001/0049944 | A1 * | 12/2001 | Shirakata | F25B 39/04 | 62/506 |
| 2003/0116306 | A1 * | 6/2003 | Besik | F16L 55/02772 | 165/109.1 |
| 2008/0190593 | A1 * | 8/2008 | Wang | F28D 7/1607 | 165/159 |
| 2009/0071634 | A1 * | 3/2009 | Turner | B01D 7/02 | 165/104.26 |
| 2009/0084532 | A1 * | 4/2009 | Agee | F28D 7/1692 | 165/170 |
| 2009/0301699 | A1 * | 12/2009 | Karrs | F28D 7/1607 | 165/159 |
| 2010/0065250 | A1 * | 3/2010 | Frommann | F28D 1/0213 | 165/95 |
| 2010/0193167 | A1 * | 8/2010 | Song | F28D 7/16 | 165/159 |
| 2010/0200521 | A1 * | 8/2010 | Sarshar | B04C 3/00 | 210/787 |
| 2011/0126583 | A1 * | 6/2011 | McCormick | F25B 27/002 | 62/603 |
| 2012/0073955 | A1 * | 3/2012 | McClanahan | F02M 21/06 | 203/99 |
| 2013/0146263 | A1 * | 6/2013 | Kim | F28D 7/0041 | 165/155 |
| 2013/0239571 | A1 * | 9/2013 | Hartmann | F01K 23/10 | 60/618 |
| 2014/0020876 | A1 * | 1/2014 | Rolland | F28F 13/12 | 165/165 |
| 2018/0363990 | A1 * | 12/2018 | Rondet | F28F 9/0131 | |

FOREIGN PATENT DOCUMENTS

| | | | | |
|---|---|---|---|---|
| CA | 2858863 | A1 * | 6/2013 | F28D 7/024 |
| DE | 2010141 | | 9/1970 | |
| DE | 2010141 | A1 * | 9/1970 | F28D 7/1676 |
| DE | 2010141 | A1 * | 9/1970 | F28D 7/1676 |
| DE | 3528426 | | 2/1987 | |
| DE | 3528426 | A1 * | 2/1987 | A23G 3/0215 |
| DE | 3528426 | A1 * | 2/1987 | A23G 3/0215 |
| DE | 10312788 | A1 * | 9/2004 | F28D 7/0075 |
| DE | 10312788 | A1 * | 9/2004 | F28D 7/0075 |
| DE | 102004012607 | A1 * | 10/2005 | A23G 3/0215 |
| DE | 102004012607 | A1 * | 10/2005 | A23G 3/0215 |
| DE | 10326792 | B4 * | 11/2005 | A23G 3/0044 |
| DE | 10326792 | B4 * | 11/2005 | A23G 3/0044 |
| DE | 102005010261 | * | 9/2006 | B23P 15/26 |
| DE | 102005010261 | A1 * | 9/2006 | B23P 15/26 |
| DE | 202009003094 | U1 * | 6/2009 | |
| DE | 102010037206 | A1 * | 8/2010 | |
| DE | 102010012629 | | 9/2011 | |
| DE | 102013004934 | A1 * | 9/2014 | F28F 9/22 |
| EP | 1266576 | A3 * | 12/2003 | A23G 3/04 |
| EP | 1266576 | A3 * | 12/2003 | A23G 3/04 |
| EP | 1486126 | | 12/2004 | |
| EP | 2584301 | | 4/2013 | |
| FR | 543239 | A * | 8/1922 | F28F 9/22 |
| KR | 20020024776 | | 4/2002 | |
| WO | 2007042529 | | 4/2007 | |
| WO | WO 2007042529 | A1 * | 4/2007 | F28D 7/1607 |
| WO | WO-2007042529 | A1 * | 4/2007 | F28D 7/1607 |
| WO | 2009064584 | | 5/2009 | |
| WO | 2011137506 | | 11/2011 | |
| WO | WO-2011140616 | A2 * | 11/2011 | B01D 53/06 |

(56) References Cited

FOREIGN PATENT DOCUMENTS

| | | | | |
|---|---|---|---|---|
| WO | WO-2016131787 A1 * | 8/2016 | ..... | F28D 7/163 |
| WO | WO 2016131787 A1 * | 8/2016 | ..... | F28D 7/163 |

OTHER PUBLICATIONS

DE 202009003094U1—English Machine Translation—Retrieved Jul. 2018.*

International Searching Authority, "International Search Report," issued in connection with PCT Patent Application No. PCT/EP2015/051960, dated Sep. 9, 2016, 3 pages.

International Searching Authority, "Written Opinion," issued in connection with PCT Patent Application No. PCT/EP2015/051960, dated Sep. 9, 2016, 9 pages.

English Version of State Intellectual Property Office of the People's Republic of China, "First Office Action," issued in connection with Chinese Patent Application No. 20158005991.5, dated Jan. 22, 2018, 12 pages.

* cited by examiner

FLOW DEVICES AND METHODS FOR GUIDING FLUID FLOW

RELATED APPLICATIONS

This patent arises as a continuation-in-part of International Patent Application No. PCT/EP2015/051960, which was filed on Jan. 30, 2015, and which claims priority to German Patent Application No. 10 2014 201 908.7, which was filed on Feb. 3, 2014. The foregoing International Patent Application and German Patent Application are hereby incorporated herein by reference in their entireties.

FIELD OF THE DISCLOSURE

This disclosure relates generally to flow devices, and, more particularly, to flow devices and methods for guiding fluid flow.

BACKGROUND

Numerous methods for guiding a fluid stream are known in heat exchangers. Some of these known heat exchangers use cross flows and/or countercurrent flows to transfer energy therebetween. However, many of these known heat exchangers are not very compact and/or utilize a significant volume for heat exchange requirements/needs.

Figure 1:
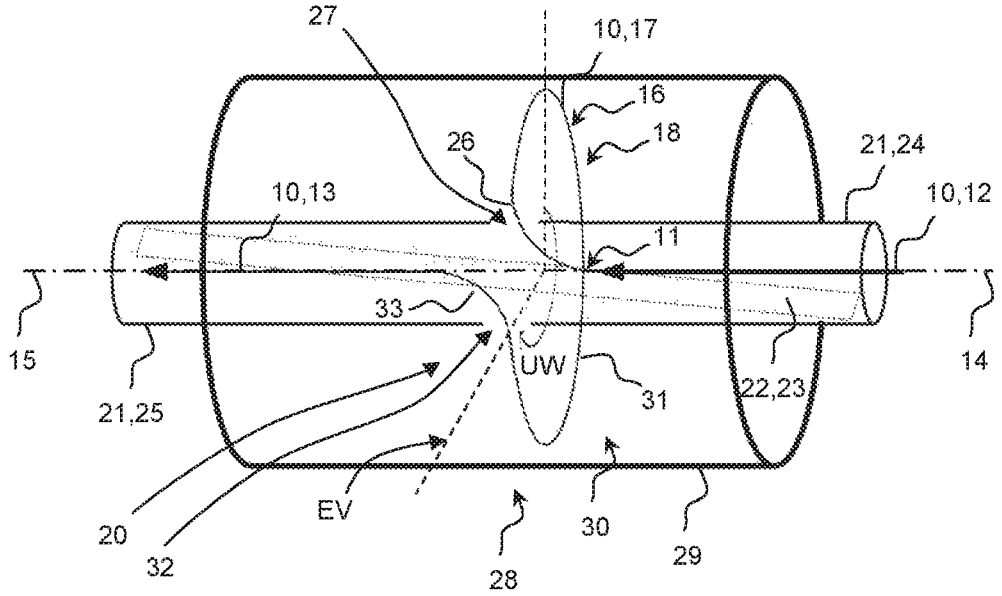
FIG. 1 shows a schematic flow profile of a fluid stream as an example method in accordance with the teachings of this disclosure.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Flow devices and methods for guiding fluid flow are disclosed. The examples disclosed herein relate to methods for guiding a fluid stream, which has an inflow and an outflow portion with substantially parallel and, preferably, coaxial inflow and outflow axes.

As used herein, an inflow portion or an outflow portion, respectively, of a fluid stream can be that part of a flow path that in the flow direction lies ahead or behind an active portion, respectively, of the entire flow path of the observed method. In such examples, an active portion can be that part of the flow path in which methods of the examples disclosed herein act on the fluid stream or in which the fluid stream is treated according to the example methods, respectively. An inflow axis or an outflow axis, respectively, is understood to be, in particular, an imaginary axis that is parallel with a flow direction in the inflow portion or the outflow portion, respectively. The inflow axis or the outflow axis, respectively, may be preferably substantially perpendicular to a cross-sectional area of the inflow portion or the outflow portion, respectively, of the flow path. These flow axes may be preferably aligned or disposed so as to be parallel with a surface normal of the mentioned cross-sectional areas.

Numerous methods for guiding a fluid stream are known. However, it is an objective of the examples disclosed herein to utilize methods and/or structural arrangements that permit a particularly compact implementation of a flow device, where the fluid stream, or a fluid flow, respectively, may be exposed to an increased and/or significantly large active length at as short a construction length of the flow device as possible. As used herein, an active length is understood to be a portion of the fluid stream or of a flow path of the fluid flow, respectively, in which said fluid stream may be exposed, subjected, or presented to reciprocal action. This reciprocal action may be a chemical, thermal, mechanical, and/or electromagnetic reciprocal action, having at least one suitable reciprocal-action partner. The reciprocal-action partner may be a further fluid stream, a solid material, an assembly or an apparatus, a reciprocal-action region of a flow device, and/or another medium.

According to the examples disclosed herein, this object may be achieved in that the fluid stream by at least one guide means between an inflow portion and an outflow portion in a circulation-flow portion at a circumferential angle, which is denoted by UW, is deflected in a radially encircling manner about the inflow axis and the outflow axis, where UW is greater than 0°. In some examples, the active length in the circulation-flow region may be advantageously set or selected based on the circumferential angle, UW.

In some examples. the guide means may, in particular, be a guide body, a guide pipe, and/or a guide duct, a partition element, preferably a partition element in a tubular guide element, and particularly preferably a partition wall in a guide pipe, and/or a combination of elements of this type, deflecting the fluid stream, or a fluid flow of the fluid stream, respectively, in any appropriate manner. In one particularly preferred example of a guide means, the latter includes a guide pipe with entry and exit connectors, respectively, which are disposed on the end sides and which at the pipe ends are adjoined by an inflow region and an outflow region, or which may be adjoined by the inflow portion and the outflow portion of the fluid stream. The guide pipe of this example may be configured to be linear such that the entry connector or the exit connector, respectively and the associated inflow regions and outflow regions of the line system, or the inflow portion and the outflow portion of the fluid stream, respectively, force or initiate, or at least facilitate, a substantially linear stream profile of the fluid flow along an inflow axis or an outflow axis, respectively. The inflow axis and the outflow axis of this example are preferably aligned to be mutually coaxial. Furthermore, in some examples, a guide element such as, in particular, a partition wall, is disposed in the guide pipe between the inflow region and the outflow region, thereby imparting a transversely running directional component to the fluid flow that flows along the inflow axis. For example, the fluid flow moving along this circulation-flow portion can be preferably subdivided into part-flows (e.g., partial flows) having radial flow directions. By utilizing additional deflection components of the guide means, the radial flows that have thus been created are thereby deflected in the circumferential direction around the inflow axis and the outflow axis before said radial flows following a circumferential angle, UW, by additional deflection components to again deflect the radial flows in the general direction of the outflow axis.

Advantageous refinements and improvements of the features stated in the examples disclosed herein are derived by the measures listed below.

One example implementation of a method that is particularly readily scalable is implemented in a flow device at a circumferential angle, UW, which is substantially an integer multiple of 30°, 45°, 60°, 90°, 180°, or 360°.

One preferred example configuration of the method is achieved in that the fluid stream enters via an entry connector into a guide pipe, thereby expanding in the guide pipe along a flow direction, where the fluid stream across a pipe portion is, in particular, in portions, preferably steadily, deflected by a partition wall to form a radial stream. In such example configurations, the radial stream by at least one radial passage in the guide pipe, may exit from the latter and enter into an intermediate space that extends about the guide pipe and is preferably formed in the substantially closed pipe jacket. As a result, the pipe jacket of these example configurations deflects the radial stream in a generally circumferential direction about the guide pipe such that the fluid stream moves into the circulation-flow portion before entering the guide pipe again through a further radial passage in said guide pipe, and being deflected again by the guide pipe along the outflow direction and guided toward an exit connector, for example.

Based on the fluid stream in the circulation-flow region engaging in reciprocal action with a further fluid stream, or at least being able to engage in reciprocal action, a particularly compact implementation of the reciprocal action between the first and the further fluid stream in a flow device may be achieved by the method according to the examples disclosed herein. In these examples, at least one fluid stream preferably undergoes a state change. As used herein a state change and/or where a change such as that of the thermodynamic state, in particular, of the temperature, pressure, volume, and/or aggregate state, and/or of a chemical state, in particular of a chemical composition, and/or of any other physical state is to be understood as a change of state or state change.

Particularly good reciprocal action between the first and further fluid streams is achieved because the further fluid stream in the circulation-flow region is subject to a substantially transverse inflow by the first fluid stream. As used herein, a "transversely running inflow" can, in particular, be understood as a flow profile in which in the region of the reciprocal action of the two fluid streams the directional vector of the first fluid stream is approximately perpendicular, but at least at an angle of at least 30° (e.g., 45°), but preferably at least 0°, to the directional vector of the further fluid stream. As used herein, the term "directional vector" of a stream can be, in particular, the local directional arrow, or the local indication of spatial direction of a respective stream portion, respectively, or of a stream cell, or of a volumetric cell of the stream, respectively.

In order to reduce, inhibit, prevent, and/or at least restrict direct contact between the two fluid streams, it is advantageous in some examples for the further fluid stream to be guided through the first fluid stream in a line system, in particular in a pipe bundle system.

In one further aspect, the examples disclosed herein relate to a flow device having a first line system for conducting a first fluid flow, where the first line system includes a guide pipe and at least one guide means influencing a flow direction of the fluid flow, and/or at least one flow body. According to the examples disclosed herein, the guide means and/or the flow body may be provided and configured to optimize a flow profile to enhance the efficiency of the flow device. As used herein, the term "optimizing a flow profile" in such examples can be understood to be setting of a dwelling time within specific portions of the flow device, suppression or the targeted creation of turbulences in specific flow portions of the fluid flow, and/or the alignment of flow directions in specific portions of the flow device and/or of specific flow portions of the fluid flow.

In one further aspect, the examples disclosed herein relate to a flow device to carry out the previously mentioned method. The flow device of such examples, preferably, has a first line system for conducting a first fluid flow, where the first line system includes a guide pipe and at least one guide means influencing a flow direction of the fluid flow such that the fluid flow between an inflow region and an outflow region of the first line system in a circulation-flow portion at a circumferential angle, UW, circulates in a generally radially encircling manner about an inflow axis and an outflow axis. In a particularly readily scalable example of the flow device, the circumferential angle, UW, may be selected, set, and/or configured as a preferably integer multiple of 30°, 45°, 60°, 90°, 180°, or 360°, etc. The line system of such examples may be a pipeline, a duct, a hollow body, and/or a system of intercoupled pipelines, ducts, and/or hollow bodies through which a fluid flow is conductible. A flow axis in such examples can be understood to be a surface normal on a cross-sectional opening area of a connector opening of the line system.

In one further aspect, the examples disclosed herein relate to a flow device having a reciprocal action between at least two fluid flows, where one of the fluid flows in particular is guided according to the previously mentioned example method. The flow device in these examples has a first line system for conducting a first fluid flow, and, preferably, at least one further line system for conducting a further fluid flow. In some examples, each of the line systems has at least one entry connector and one exit connector for infeeding or discharging, respectively, the respective fluid flow. A connector of these examples, in particular, such as an entry connector or exit connector, can henceforth be understood to be a line portion of the line system, which is disposed ahead of or behind, respectively, in the flow direction, a process portion of the fluid stream or of the respective fluid flow, respectively, or a respective flange or a connection flange, respectively, which is disposed in a corresponding manner on the respective line system, and/or a port that is disposed on the respective line system and which serves for infeeding or discharging the respective fluid flow, respectively.

Flow devices of this type are often implemented as boilers, heat exchangers, and/or evaporators where in principle a favorable utilization of space is possible. That is to say, as large a contact or transfer surface is possible to be achieved between the fluid flows. In some examples, this may be achieved by aligning a main flow axis of the second fluid flow to be substantially parallel with the inflow axis and/or outflow axis of the first fluid flow. In these examples, the inflow axis and the outflow axis of the first fluid flow are, preferably, aligned to be mutually coaxial. A main flow axis of this example can be understood to be an axis along which, or parallel with which, respectively, a flow of at least 50% of a total path length, for example, of a line system expands.

In one preferred example configuration, a flow axis of at least one of the two connectors of the further line system is aligned so as not to be parallel with at least one flow axis of one of the two connectors of the first line system, preferably, at angle of greater than 45°, for example, and particularly preferably almost perpendicularly thereto. An arrangement of this type may be of advantage in particular when the flow device is used as an evaporator or as a heat exchanger between gaseous and liquid fluid flows, for example.

However, in some examples, it may also be advantageous for a flow axis of at least one of the two connectors, preferably of both connectors, of the further line system to be aligned so as to be substantially parallel with a flow axis of one of the two connectors of the first line system. In particular, when the flow device is used as a heat exchanger between two liquid fluid flows, the second variant mentioned may lead to an advantageous compaction of the flow device or of the installation thereof in a pipe system or a plant.

If and when the entry connector and the exit connector, in particular the flow axes of the entry connector and of the exit connector, of at least one of the line systems lie in one plane, preferably being aligned so as to be mutually parallel, particularly preferably being aligned so as to be mutually coaxial, a flow device which is readily capable of integration into existing plants may be achieved. In some examples, a coaxial arrangement of the entry connector and of the exit connector of the first line system, in particular, permits simplified integration of the flow device into existing line systems of the first fluid flow. In this way, the flow device may be integrated directly into an existing line network for conducting a first fluid flow to utilize exhaust heat from the first fluid flow, for example, by replacing a linear line portion with the flow device.

For the fluid flow from the further line system of the flow device to be able to be provided in a readily manageable manner, it may be advantageous, in some examples, for the entry connectors and the exit connectors, in particular, the flow axes of the entry connector and of the exit connector, of at least one, preferably of each line system of the flow device to in each case lie in one plane, preferably to be aligned so as to be mutually parallel, and particularly preferably to be aligned so as to be mutually coaxial, wherein the respective planes preferably form an angle between 45 and 90°, for example.

However, it may also be advantageous in some examples when the entry connector and the exit connector of the further line system are disposed on mutually opposite end regions of the pipe jacket, along a longitudinal extent of the guide pipe. Preferably, the entry connector and the exit connector in these examples may be aligned so as to face away from the guide pipe in the substantially radial direction and may, in particular, be disposed so as to face in mutually substantially diametrically opposing directions. A configuration of such examples may be employed in scenarios where further line systems are substantially constructed from linear pipe portions or pipe lengths.

In one preferred configuration, the flow device according to the examples disclosed herein includes a generally cylindrical shape extending along a main axis, where the flow axis of the entry connector and/or the exit connector of the first line system is aligned to be substantially parallel, and may be preferably coaxial with the main axis.

In one preferred refinement example of the flow devices according to the examples disclosed, the entry connector and/or the exit connector of the further line system may be disposed in the proximity of the entry connector or exit connector of the first line system, where the flow axis of the entry connector and/or of the exit connector of the further line system is aligned to be substantially perpendicular to or, alternatively, substantially parallel with the main axis.

Alternatively, in some examples, it may also be advantageous for the entry connector of the further line system to be provided/disposed in proximity of the entry connector of the first line system while the exit connector of the further line system is disposed in proximity of the exit connector of the first line system, or vice-versa. These examples may be advantageous, in particular, where flow devices have further line systems that are substantially constructed from linear pipe portions or pipe lengths.

In some examples, if the first line system is formed substantially by a guide pipe and a pipe jacket enclosing the guide pipe, where the pipe jacket encloses or forms, respectively, an intermediate space extending between the guide pipe and the pipe jacket, and where the entry connector and the exit connector of the first line system are disposed on the two substantially opposite ends of the guide pipe, a flow device according to the examples disclosed herein, or a flow device for carrying out the method according to the examples disclosed herein, respectively, may be obtained in a particularly simple manner.

An example in accordance with the teachings of this disclosure that is particularly advantageous because it is capable of easy assembly is obtained when the pipe jacket is configured in the manner of a hood. In particular, having a substantially cylindrical jacket structure and one base or an assembly portion, respectively, at each end, where the base may be contiguous to a connector portion of the guide pipe. For example, the assembly portion may be configured as an assembly shoulder and/or a bearing face and/or an annular bearing, for example. The assembly portion can, in particular, be provided to dispose and/or attach the pipe jacket onto another component, or on another functional group of the flow device, in particular, to fix the pipe jacket thereto.

In one further preferred design example of the flow device according to the examples disclosed herein, or of a flow device for carrying out the method according to the examples disclosed herein, respectively, in the guide pipe, in particular, between the entry connector and the exit connector, a partition wall, which runs obliquely through a longitudinal cross section of the guide pipe, is disposed as a guide means, for example. In such examples, a flow portion in the region of the entry connector or of the exit connector, respectively, forms the inflow portion or the outflow portion, respectively, of the fluid stream. The guide pipe, in this region that is enclosed by the pipe jacket, in the jacket face thereof in each case has at least one, preferably, a plurality of radial passages for the passage of the first fluid flow from the guide pipe into the intermediate space, or for the passage from the intermediate space into the guide pipe, respectively, along a flow direction of the first fluid flow. For example, the circulation-flow portion of the first fluid stream is preferably disposed or located in this intermediate space. In some examples, the partition wall, along with the radial passages in the guide pipe, advantageously permits the first deflection and optionally the subdivision of the first fluid flow into radially directed part-flows while the pipe jacket significantly ensures deflection in the circumferential direction.

In some examples, if in the flow direction of the first fluid flow, at least on a part of the guide pipe that points from the entry connector in the direction toward the partition wall in the region of at least one radial passage, at least one flow guide body that preferably extends into the guide pipe is provided, the implementation of the method according to the examples disclosed herein in the flow device may be facilitated in an advantageous manner. As used herein, the term "an arrangement in the region of a radial passage," for example, can be understood to include that the flow guide body may be provided or disposed in the flow direction ahead of the radial passage, level with the radial passage, and/or downstream of the respective radial passage. The flow guide body of these examples advantageously acts in a homogenizing and/or a turbulence-suppressing manner on the first fluid stream, the first fluid flow, and/or the respective part-flow.

In one other aspect, the flow device according to the examples disclosed herein may be improved in that a first flow cross section, denoted by QE, of a part of the guide pipe that faces towards and/or directed towards the entry connector along the flow direction of the first fluid flow decreases substantially at the same rate as a second flow cross section, denoted by QA, of a part of the guide pipe that faces the exit connector increases along the flow direction of the first fluid flow. In some examples, the sum of QE plus QA is, preferably, not greater than a flow cross section in the entry connector, where in particular applications of the flow device a configuration of the total cross section of QE plus QA in relation to the entry cross section or the exit cross section of the connectors deviating from the above may also be of advantage. In this example configuration, the first fluid flow flowing in from the entry connector and the first fluid flow flowing out in the direction of the exit connector may be distributed as uniformly as possible across an axial length of the intermediate space or the circulation-flow region or portion, respectively, or at least of an axial portion of the intermediate space, or may be brought together again from the latter, respectively. The advantageous pressure-minimizing and/or turbulence-suppressing effect of the construction according to the examples disclosed herein is supported in this manner. In such examples, a steady monotonous or a strictly monotonous variation of the cross sections QE, QA, as a function of the axial positioning along the intermediate space, the circulation-flow portion, or the circulation-flow region is advantageously describable or configured. In a relatively simple configuration, the profile of the first flow cross section QE is linear, reducing in a linear manner, while the profile of the second flow cross section is linear, increasing in a linear manner, at the same rate. However, more complex curve profiles may also be advantageous. For example, depending on the characteristic of the first fluid flow, a hyperbolic, a parabolic, an exponential, and/or any other suitable curve profile(s) may be advantageous, in particular, depending on the axial positioning along the intermediate space of the circulation-flow portion or of the circulation-flow region, for example.

In other refinements of the examples disclosed herein, the radial passage or radial passages, respectively, in relation to the circumference is/are configured in a slotted manner. For example, passages of a slotted manner in this context, apart from integral substantially elongate recesses, breakthroughs, or passages, can also be understood to be a number of relatively small passages such as bores, meshes, etc., which in their entirety function similar to a slot and disposed and/or grouped along the longitudinal extent/direction, for example. Alternatively or additionally, in some examples, the radial passages may also be configured as planar recesses, bores, or breakthroughs. In a preferred embodiment the radial passages, or the effective radial passage resulting from relatively small passages, have an effective passage width that is preferably smaller than or substantially equal to a passage length of the radial passages or of the radial passage resulting from small passages in relation to a longitudinal extent of the guide pipe. For example, the radial passages or the small passages may be introduced or may have been introduced into the jacket of the guide pipe by cutting, punching, chipping, and/or forming processing. Furthermore, a cross-sectional area of the radial passage or of a sum of the cross-sectional areas of the radial passages is preferably between 25% and 400% (e.g., between 90% and 300% and particularly preferably between 140% and 270%, etc.) of the flow cross section in the entry connector.

In the example of one further advantageous refinement of the example flow devices, the further line system includes a manifold and a pipe-bundle system, where at least the entry connector of the further line system is disposed on the manifold, opening into a manifold space provided in the manifold. In some examples, the pipe jacket may preferably be disposed on a lateral face of the manifold such as, in particular, on a flange face, for example. In one example refinement, the exit connector of the second line system is also disposed on the manifold, likewise opening into the manifold space that in terms of the exit connector may also be understood to be a collection space. In this design example, it may inter alia be advantageously achieved that the pipe jacket that radially delimits the intermediate space, the circulation-flow portion, or a reciprocal-action region, in the example of assembly or disassembly, respectively, may, as an entire component, be axially traversed across the pipe-bundle system without the second line system having to be moved or manipulated in any other way here. On account thereof, the pipe jacket may be designed in a particularly simple manner as a hood which is capable of axial assembly, so as to be fitted over or slid onto the guide pipe of the first line system, respectively. In this example configuration, the flow device according to the examples disclosed herein becomes particularly amenable to assembly and maintenance since comparatively large sub-assemblies of the flow device may be pre-assembled in a mutually independent manner, be easily opened in the joined-up state, and be easily separated from one another again, respectively.

In one particularly preferred design example, the manifold space by means of at least one partition element is subdivided into at least one entry chamber and one exit chamber, where the entry connector opens into the entry chamber, and the exit connector opens into the exit chamber, for example.

In one further preferred design example, the pipe bundle system includes at least one, preferably a plurality of pipe loops, where each pipe loop extends into the intermediate space between the guide pipe and the pipe jacket, and preferably, at the entry side to operationally connect/couple with the entry connector or the entry chamber, and at the exit side being operationally connected with the exit connector or the exit chamber in such a manner that the further fluid flow flowing in through the entry connector may at least partially flow through the respective pipe loop to the exit connector or to the exit chamber. The configuration as pipe loops of such examples, likewise, facilitates the construction in the form of pre-assembled sub-assemblies of the flow device according to the examples disclosed herein, which is preferably capable of assembly in an axial manner. An example configuration of the pipe bundle system in this manner can be particularly suitable for a combination with a manifold on which both the entry connector as well as the exit connector of the further line system are provided.

In one alternative or additional example, the pipe-bundle system may also include substantially linear pipe portions or pipe lengths, or may at least partially be constructed from the latter instead of from pipe loops. For example, the pipe portions or pipe lengths can couple/connect the manifold space of the manifold to a collection space that is preferably provided at an end of the pipe lengths that is remote from the manifold. The pipe portions or pipe lengths in the longitudinal direction thereof, preferably, but at least in portions, extend once into the intermediate space or therethrough. where said pipe portions or pipe lengths, in particular, penetrate or traverse the reciprocal-action portion or the circulation-flow portion in the intermediate space once, for example. Preferably, in some examples, the collection space is connected/coupled to the exit connector of the further line system, In particular, the exit connector may be provided on a collector head that forms the collection space, or substantially encloses the latter, and which is similar to the manifold, for example.

In a preferred refinement example, further partition elements for forming intermediate chambers between the entry chamber and the exit chamber are provided in the manifold space, where at least one additional pipe loop is provided per intermediate chamber, where the pipe loops do not connect/couple the exit chamber directly to the entry chamber, but where the further fluid flow may first make its way sequentially from the entry chamber via at least one intermediate chamber to the exit chamber, where said fluid flow flows through at least two pipe loops. In this construction, the pipe bundle system may readily be configured as a system with multiple passes, a pass or the number of passes of a pipe-bundle system such as, in particular, being understood as the number of simple pipelines or the double number of pipe loops through which at least a part-flow of a fluid flow flowing through a line system that comprises the pipe-bundle system flows between an inflow portion and an outflow portion, for example.

In one other aspect of refining the flow device according to the examples disclosed herein, a flow body is disposed in at least one line system, such as, in particular, at transitions of cross sections or at deflections of flow directions. For example, the flow body is assigned the task of minimizing a pressure loss in the fluid flow that flows through the line system, in particular, at transitions of cross sections or at deflections of flow directions, by a suitable deflection and/or homogenization. In such examples, the homogenization of the stream through the flow body furthermore has the advantage that any deposition, attachment, and/or accumulation of contaminants that are entrained by the fluid stream, (e.g., pollutant particles such as ash, scum, or the like, etc.) in the line system, in particular, at functionally necessary transitions of cross sections or deflections of flow directions, is reduced and/or minimized. This effect can result from a reduction of the thickness of the barrier layer in the respective flow region. As a result, a cleaning interval and, thus, a net operational period of the flow device may advantageously be extended by providing suitable flow bodies in the line system or in the line systems, respectively, of the flow device. This may prove to be an advantage, in particular, in the case of heat exchangers or piped plants, respectively, for flue gas from bio-mass incineration and combustion, for example.

One example of a flow body that is to be particularly preferred is configured in the manner of a sleeve, where the former has at least one deflection body for influencing a flow direction of a fluid stream that during operation surrounds the flow body. The flow body of this example is insertable or inserted, respectively, as a preferably replaceable element in the respective piping position of the line system of the flow device. In particular, flow bodies of this type may also be embodied and configured as retrofit solutions that may be subsequently inserted into already existing flow devices such as, but not limited to, heat exchanges, evaporators, boilers, and/or line systems for conveying fluids (e.g., heating systems, fluid supply systems, tank farms, etc.), for example. Flow bodies of this type may be introduced or replaced in a particularly simple manner at existing connection points in line constructions of this type by releasing the connection, inserting/exchanging the flow body, and subsequently restoring the connection, without the number of sealing points in the system being disadvantageously varied. The corresponding retrofit kits may be introduced in a particularly advantageous manner in line portions of which the effective cross section is not the limiting effective cross section of the relevant system or device, respectively, wherein a limiting cross section in certain circumstances may at least be compensated for or even advantageously widened by significant homogenization of the flow.

If the flow devices according to the examples disclosed herein are used with fluid streams which are at least temporarily more heavily impacted with particles, it may be advantageous to have an apparatus to separate and discharge particles, which includes a separator, a collection region, and a conveying unit (e.g., a discharge worm conveyor, etc.) to be provided in the pipe jacket. An apparatus of this example configuration may be disposed in a particularly ready manner on the pipe jacket according to the example disclosed herein, and may be preferably example as an apparatus that is pre-assembled with the pipe jacket or is integrated in the pipe jacket, on account of which the capability of ready assembly and/or maintenance of the flow device according to the examples disclosed herein is advantageously maintained.

The flow device according to the examples disclosed herein may furthermore be advantageously refined by a droplet separator that is preferably disposed in/within the connector to the exit chamber or on the exit connector, respectively. The droplet separator that may preferably be fastened to the manifold, is received in the manifold, or is integrated therein. In particular, the condensate which has been collected in a separation space of the droplet separator by at least one return line may be supplied to the entry chamber or at least to an intermediate chamber in the manifold, for example. This example of a flow device according to the examples disclosed herein is of advantageous for the use as an evaporator, where the fluid stream in the first line system substantially serves as the heat source for the evaporation of the further fluid stream in the second line system, for example. In some examples, non-evaporated proportions of the second fluid stream or the further fluid stream, respectively, in this manner may be readily returned or re-supplied, respectively, to the evaporation process in the flow device to the pipe-bundle system conducting the further fluid stream.

In one other preferred example, the flow device according to the examples disclosed herein has a bypass installation of which the first fluid flow at least partially, and/or an adjustable, preferably regulatable proportion between 0 and 100% of the fluid flow may be guided past the first line system, in particular, past the circulation-flow portion of the first line system of the flow device, for example. The bypass installation of this example is provided for guiding the respective proportion of the first fluid flow past the deflection by the guide means in the first line system. In this manner, the proportion of the first fluid flow by the guide means is deflected and, thus, supplied to a circulation-flow region, may be configured by the bypass installation to be advantageously adjustable. In this example, in an exemplary application of the flow device according to the examples disclosed herein as a heat exchanger, between a first fluid that carries heat and flows in the first line system, and a second fluid that absorbs heat and in the circulation-flow region may act reciprocally in a heat-transferring manner with the first fluid, where the amount of heat which is transferable to the second fluid may be set and/or regulated by the bypass installation since the proportion of the first fluid which flows into the circulation-flow region may be controlled/restricted via the bypass installation.

The bypass installation in some examples has at least one bypass line and one bypass actuator, where the bypass line is preferably disposed between the entry connector and the exit connector of the first line system of the flow device.

The bypass line of the examples disclosed herein may be configured as an internal pipe that is disposed in the guide pipe of the first line system and engages through the guide pipe, preferably in a centric manner along the main flow axis. Alternatively or additionally, the examples disclosed herein may also be provided with a bypass line that is composed of one or a plurality of part-lines that extend along the guide pipe through the first line system. In one preferred example, the bypass line penetrates the partition wall that is disposed in the guide pipe such that the proportion of the first fluid flow expanding through the bypass line is not deflected into the circulation-flow region or does not have a significant circulation-flow portion.

Alternatively or additionally, in some examples, the bypass line may also be configured as a line on an external wall of the flow device such as, in particular on an external wall of the pipe jacket, for example. Preferably, in some examples, the bypass line may be configured as a bypass jacket that encloses the pipe jacket. The example bypass jacket configures the bypass line or a bypass duct between the external wall such as, in particular, the external wall of the pipe jacket and an internal wall surface of the bypass jacket.

In some examples, the bypass actuator has at least one flow regulator such as, in particular, a valve and/or a flap and/or any other fluid control element that is suitable for reducing, subdividing and/or deflecting. In such examples, the bypass actuator may be constructed as a flow divider, for example, such as a funnel-type flow divider with an adjustable flap. The flap may be disposed in the bypass line or in the first line system, in particular in the guide pipe, such that, dependent on a switched position of the flap, where the inflowing first fluid stream may pass via the flow divider into the first line system and/or into the bypass line. Alternatively, the bypass actuator may also be configured as a closable discharge mesh that is disposed in the bypass line or in the first line system such as, in particular, the guide pipe, thereby selectively enabling communication therebetween. The discharge mesh of these examples acts as a flow divider and may be selectively opened and/or closed (e.g., by a rotary valve and/or an axial slide valve). Alternatively, in some examples, the discharge mesh is disposed in and/or along the flow direction (e.g., in the main flow direction) and/or is disposed ahead of a flap such that the flap may selectively open and/or close the passage to the bypass line.

In one further aspect, the examples disclosed herein relate to a use or the configuration, respectively, of a flow device according to the examples disclosed herein as a heat exchanger such as, in particular, as a cross-flow or as a cross-parallel flow heat exchanger of the gas-gas, gas-liquid, liquid-gas, liquid-steam, steam-liquid, gas-steam, steam-gas, or liquid-liquid type between two at least partially gaseous, one at least partially liquid and one at least partially gaseous or two at least partially liquid fluid streams, etc. Gaseous fluids are also understood to be fluids in the form of steam or partially in the form of steam. In one particularly preferred use according to the examples disclosed herein, the flow device may also be employed according to the examples disclosed herein as an evaporator of a further liquid fluid flow at the entry side by transferring heat from a first fluid flow.

The abovementioned types of use according to the examples disclosed herein may, in addition to other applications, have particular relevance to thermal energy plants such as plants preferably operating on the Rankine cycle, particularly preferably having plants for carrying out a Rankine cycle using an organic operating fluid. For example, the organic operating fluid, as the further fluid flow flowing through the further line system of the flow device according to the examples disclosed herein, by heat transfer from the first fluid flow flowing in the first line system may be heated in such a manner that the former at least partially converts from a liquid phase to a vapor phase. The fluid streams in the flow device according to the examples disclosed herein remain separated from one another such that the most varied types of heat-conducting fluids (e.g., flue gas, exhaust gas, hot water, warm water, in particular from a solar and/or geothermal source, process fluids from industrial processes that require cooling, etc.) may be employed as first fluid flows as an energy source for the Rankine cycle.

In some examples, preferably a Rankine cycle, the further fluid flow, which in the Rankine cycle acts as an operating medium in the assigned line system of the flow device by heat transfer from the first fluid flow is at least partially, in particular to the extent of at least 60%, for example, preferably almost entirely, converted from a liquid phase to a vapor phase. An operation of the Rankine cycle with direct evaporation can be understood to be an operating mode in which the operating medium of the Rankine cycle, which flows as a further fluid flow in a flow device by heat transfer from the first fluid flow, which is supplied to the flow device as exhaust air/exhaust gas of a precursor process that carries exhaust heat, is converted directly and at least partially from the liquid phase thereof to a vapor phase. Alternatively, in some examples, an additional heat-transfer stage can be provided between the exhaust air/exhaust gas that carries exhaust heat, in which thermal energy from the exhaust air/exhaust gas is transferred to an intermediate medium (e.g., thermal oil, etc.) and from the latter to the operating medium in a next heat-transfer stage.

In one further aspect, the examples disclosed herein relate to a system of at least two flow devices of the aforementioned type. The two flow devices are sequentially interconnected, where the exit connector of the first line system of the first flow device is connected, coupled in a substantially direct manner to the entry connector of the first line system of the second flow device, and where the exit connector of the second line system of the first flow device is connected to the entry connector of the second line system of the second flow device via a connection line. By way of a system of this type, for example, an effective reciprocal-action length between the first and the second fluid flow may be doubled, where relatively small units of flow devices may advantageously be utilized without having to undertake the layout of a new flow device with relatively larger dimensions. In some examples, it may also be advantageous when the system couples two flow devices of the type mentioned at the outset as a system, where said flow devices have dissimilar or deviating conception such as, in particular, the second line system being of dissimilar or deviating dimensions. Deviating dimensioning of the flow devices in such examples may be understood to be a mutually deviating configuration in terms of the type of lines and/or line cross sections and/or the number of passes and/or the configuration of the manifold of the entry chamber, the intermediate chamber, and/or the exit chamber, and/or the configuration of the guide means, the number and/or the configuration of radial passages and/or the configuration of the partition wall.

In one further aspect, the examples disclosed herein relates to a thermal power plant, in particular a plant for generating mechanical and/or electrical energy according to the Rankine cycle with at least one flow device of the aforementioned type. In such examples, the further fluid flow of the flow device is preferably formed by an operating medium such as, for example, an organic operating fluid, where the operating medium may be at least partially evaporated in the flow device according to the examples disclosed herein by transferring heat from a first fluid flow.

An example apparatus includes a central channel defining a central flow of a first fluid that that is to flow between a first end and a second end of a heat exchange volume, where the central flow is to generally flow along a longitudinal direction of the central channel, and a deflecting guide to cause the central flow to have a radial flow component. The example apparatus also includes a guide channel defining a secondary flow of a second fluid, wherein at least a portion of the guide channel extends along the longitudinal direction in the heat exchange volume.

In some examples, the deflecting guide extends at an oblique angle along the longitudinal direction. In some examples, the guide channel extends from proximate the second end, loops through the heat exchange volume, and returns to the second end. In some examples, the guide channel includes a transverse return portion, and wherein the secondary flow flows along the longitudinal direction at least twice before exiting the heat exchange volume. In some examples, the secondary flow enters the apparatus at a direction generally perpendicular to the longitudinal direction. In some examples, the secondary flow exits the apparatus at a direction generally perpendicular to the longitudinal direction. In some examples, a portion of the guide channel extends across a circumferential portion of the apparatus.

An example method includes directing a first fluid to flow along a longitudinal direction between a first inlet and a second inlet of a heat exchange volume, and deflecting the first fluid to cause a radial flow component of first fluid flow to be defined. The example method also includes directing a second fluid to flow within a channel disposed in the heat exchange volume, where the channel is to extend along the longitudinal direction, and where in at least a portion of the channel, the second fluid flows countercurrent to a longitudinal flow component of the first fluid.

In some examples, the example method also includes directing the second fluid to flow substantially perpendicular to the longitudinal direction during at least one of an entry or an exit of the second fluid relative to the heat exchange volume. In some examples, the channel is proximate an outer diameter of the heat exchange volume. In some examples, the radial flow component is defined by a separation wall extending at an oblique angle along the longitudinal direction. In some examples, the separation wall is defined by an inner channel extending along the longitudinal direction within the heat exchange volume.

Advantageous exemplary embodiments of the examples disclosed herein are schematically illustrated in the drawings and discussed in more detail below with the following description.

A schematic impression of the method for guiding a fluid stream in accordance with the teachings of this disclosure is imparted by FIG. 1. According to the illustrated example, a fluid stream 10 follows and/or moves along a flow path 11 between an inflow portion 12 and an outflow portion 13. In this example, the fluid stream in the inflow portion 12 follows substantially a linear inflow axis 14, and, likewise, in the outflow portion 13, follows a substantially linear outflow axis 15. The inflow axis 14 and the outflow axis 15 of the illustrated example are aligned so as to be mutually parallel and/or substantially parallel. In the example of FIG. 1, said axes are shown in a preferred mutually coaxial alignment.

According to the illustrated example of FIG. 1, an intermediate portion of the flow path 11 of the fluid stream 10 lying between the inflow portion 12 and the outflow portion 13 may be referred to as a process portion 16. At least one guide means 20 for directing the flow path 11 is disposed between the inflow portion 12 and the outflow portion 13. The guide means 20 in this example acts on the fluid stream 10, in particular the process portion 16 of the fluid stream 10. In this examples, the fluid stream 10 in the process portion 16 is deflected via the guide means 20 in such a manner that said fluid stream 10 in a circulation-flow portion 17 of the process portion 16 may radially encircle the inflow axis 14 and the outflow axis 15 in a manner according to the examples disclosed herein. In this example, the circulation-flow portion 17 of the fluid stream 10 may be substantially characterized by a circumferential angle, which is denoted as UW.

According to the illustrated example, the circumferential angle, UW, can be understood to be an angular measure of the extent of the circulation-flow portion, or of part of the flow path 11 along a circumferential line 18 about the inflow axis 14 or the outflow axis 15, respectively. In this example, the fluid stream 10 in the circulation-flow portion 16 substantially expands along this circumferential line 18, or moves substantially along this circumferential line 18 in the circulation-flow portion 17. The circumferential line 18 of the illustrated example extends helically about the inflow axis 14 and the outflow axis 15, respectively, and particularly preferably substantially in a plane (e.g., a single plane), which as denoted as EV. The example plane EV in relation to the inflow axis 14 and the outflow axis 15, respectively, forms an angle that is unequal to zero, where the inflow axis 14, and the outflow axis 15, respectively, preferably intersect the plane EV at an angle of at least 45°, for example, and where the inflow axis 14 and the outflow axis 15, respectively, particularly preferably intersect the plane EV almost perpendicularly, and where an angular deviation of up to ±10° is still to be understood as almost or substantially perpendicular.

The illustrated example of FIG. 1 furthermore shows a preferred and readily manufacturable example of the at least one guide means 20. In particular, the example guide means 20 comprises a guide pipe 21 that preferably surrounds the inflow axis 14 and the outflow axis 15 of the flow path 11 in a substantially coaxial manner. In this example, a partition wall 22 is disposed as a deflection means 23 in the guide pipe 21. The example partition wall 22 subdivides an interior space of the guide pipe 21, which receives the fluid stream 10, in two preferably substantially separated segments, in particular, into an inflow-side pipe portion 24 and an outflow-side pipe portion 25, for example. The partition wall 22 as part of the guide means 20 in this example is disposed or configured, respectively, such that the fluid stream 10 along the pipe portion 24 is, in particular, in portions, preferably steadily deflected to form a radial stream. As used herein, a radial stream can be understood to be a stream that runs substantially in the radial direction in relation to the inflow axis 14 and the outflow axis 15, respectively. The radial stream 26 of the illustrated example of FIG. 1 exits from the guide pipe 21 through at least one radial passage 27 in the guide pipe 21.

In this example, in at least one pipe portion 28 about the at least one radial passage 27 of the guide pipe 21, the latter is enclosed by a pipe jacket 29. For example, the pipe jacket 29 along with the guide pipe 21 configures and/or defines an intermediate space 30. As a result, the radial stream 26 enters into this intermediate space 30 via the radial passage 27, and radial stream 26 moves into the circulation-flow portion 17. To this end, the radial stream 26 of the illustrated example is deflected along an internal wall of the pipe jacket 29, thereby defining/forming a circumferential flow 31. As used herein, a circumferential flow 31 can be understood to be a flow along the circumferential line 18.

The example circumferential flow 31 expands across the circumferential angle UW about the guide pipe 21, where at least one further radial passage 32 through which the fluid stream 10 may enter into the outflow-side pipe portion 25 of the guide pipe 21 is provided in the guide pipe at an angular spacing that corresponds substantially to the circumferential angle, UW. The radial passages 27 and 32 of the illustrated example along the guide pipe 21 preferably have an axial spacing that corresponds to a deviation in the orientation of the plane, EV, from the orthogonal in relation to the inflow axis 14 and the outflow axis 15, or is a result thereof. In this example, once the fluid stream 10 in the circulation-flow portion 17 has passed through the circumferential angle, UW, the fluid stream 10 in the region of the radial passage 32 is deflected by the arising pressure conditions that form (e.g., cause to form) a radial stream 33 that enters into the outflow-side pipe portion 25 through the radial passage 32.

This radial stream 33 in a method step according to the examples disclosed herein is imparted a deflection in the axial direction, whereupon the flow direction of the former as the outflow direction again runs substantially parallel relative to the outflow axis 15.

The illustrated example of FIG. 1 shows a method having a circumferential flow 31 in one direction, in particular, in a first rotation direction along the circumferential line 18. However, other examples having a second direction that is substantially counter to the first direction are also possible. In particular, examples having at least two part-flows with opposed directions may also be advantageous as will be discussed in detail in connection with FIGS. 3 and 6 below. In one preferred design example, means for setting a specific direction at least in portions, that direct the fluid stream on/towards the flow path 11 between the inflow portion 12 and the outflow portion 13 in a selected direction, may also be employed in this example.

A refinement of examples disclosed herein may be achieved in that two, three, or more radial passages 27, 32 are provided on the inflow side and/or the outflow side on account of which the fluid stream 10 along the partition wall 22 is converted to part-flows (e.g., partial flows). These example part-flows may then each have a dedicated process portion 16, which may preferably be oriented to be substantially parallel with the others, for example.

Figure 2:
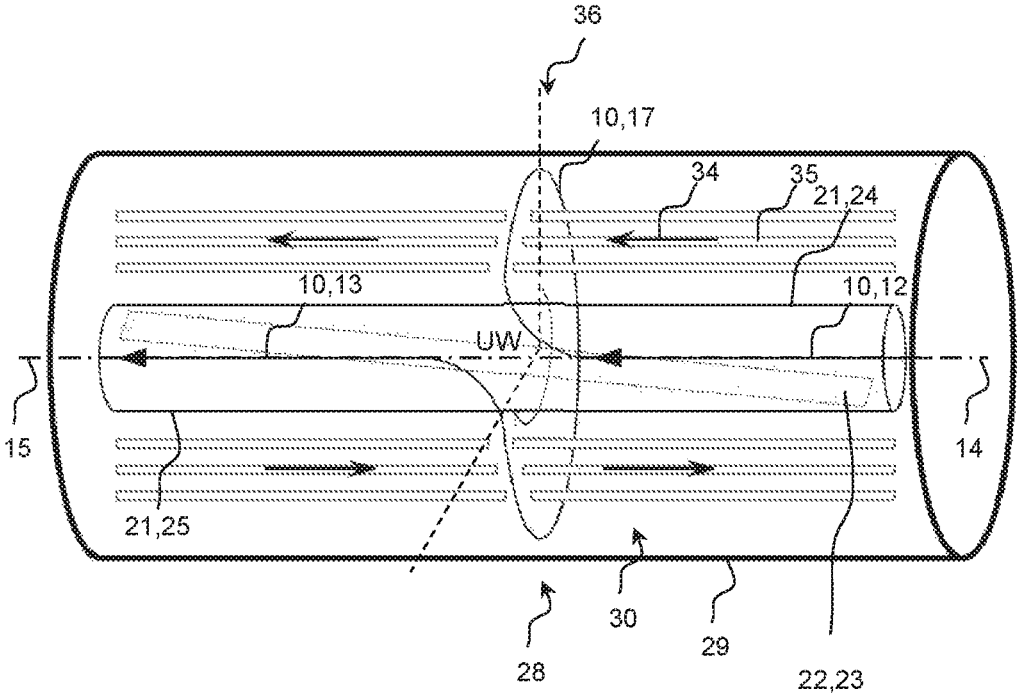
FIG. 2 shows a fluid stream of FIG. 1 in reciprocal action with a further fluid stream as an additional example of the method of FIG. 1.

FIG. 2 shows an advantageous example refinement of the method of FIG. 1, where the reference signs of identical or equivalent features are continued. In this example, a further fluid stream 34 that at least in the region of the pipe portion 28 expands preferably in a manner parallel with the guide pipe 21 and/or parallel with the inflow axis 14 and the outflow axis 15 of the fluid stream 10, respectively, is provided in the intermediate space 30.

Depending on the appropriate use of the example methods disclosed herein, free, partially directed, and/or guided expansion of the further fluid stream 34 at least along the pipe portion 28 in the intermediate space 30 may be provided. For example, free expansion can be understood to be an expansion in the intermediate space 30, which is restricted by the pipe jacket 29 and the guide pipe 21 in this example. As used herein, partially directed expansion can be understood to be a direction at least in portions of the further fluid stream 34, or of at least a part-flow diverted therefrom by use of guide means (e.g., pipe segments, directional elements, flow bodies, or the like, etc.). Guided expansion can be understood to be a direction of the further fluid stream 34 as an entire flow or as part-flows by use of guide means (e.g., pipe segments, directional elements, flow bodies, or the like, etc.), which may be substantially closed with respect to the intermediate space 30.

Conducting the further fluid stream 34 or part-flows diverted therefrom, respectively, in pipelines 35 that run through the intermediate space 30 as is illustrated as an exemplary embodiment in FIG. 2, is an example of guided expansion. In this example, the pipelines 35, which are at least in a portion 36 of the intermediate space 30 that covers or comprises the process portion 16 of the fluid stream 10, are preferably disposed to be substantially parallel relative to the guide pipe 21 or the pipe jacket 29. According to the illustrated example, reciprocal action between the fluid stream 10 and the further fluid stream 34 flowing in the pipelines 35 substantially arises in the circulation-flow portion 17 of the fluid stream 10. The pipelines 35 or the further fluid stream 34, respectively, in this example have a substantially transverse inflow, in particular, the respective flow directions are preferably substantially perpendicular to one another. In some examples, it may furthermore be of particular advantage for the pipelines 35 to be disposed in the portion 36 of the intermediate space 30 to be at least relatively uniformly spaced apart, preferably almost in a homogeneous manner. First, this example configuration has the advantage that the fluid stream 10 in the circulation-flow portion 17 by the pipelines 35 has reduced deflections and/or is deflected as little as possible from the almost circular expansion thereof along the circumferential line 18. Second, a reciprocal-action zone between the two fluid streams 10, 34 may be utilized in as homogeneous a manner as possible for reciprocal action between said streams, where a homogeneous reciprocal action can be understood to be an entire reciprocal action having few dissimilarities (e.g., as few dissimilarities as possible) between the reciprocal actions of adjacent part-flows, for example. In some examples, it may be furthermore advantageous in the application of the method for the pipelines 35 to be at least part of a pipe-bundle system such that the further fluid stream 34 is guided through a pipe-bundle system as the line system.

The example variant of the method per FIG. 1, which is shown as an example, can be particularly suitable for a thermal reciprocal action between the fluid stream 10 and the further fluid stream 34 because the pipelines 35 can significantly/largely suppress direct contact between the fluid streams 10, 34. The example method embodied in this manner is particularly suitable for use in flow devices that can be embodied as a heat exchanger and/or an evaporator, for example. In principle, however, it would also be conceivable that at least a portion of the pipelines 35 may be configured to be permeable or partially permeable. As used herein, partially permeable can be understood to be permeability with a filtration effect, in particular permeability with a mechanical filtration effect and/or selective permeability in the sense of a membrane effect (e.g., a semi-osmotic membrane). In this manner, the method according to the examples disclosed herein could also be advantageously utilized for reactors, in particular chemical, biochemical, or other process devices in which the reaction of at least part-components of one of the fluid streams 10, 34 with at least part-components of the respective other fluid stream 34, 10 is relevant. The aforementioned advantageous transverse inflow of the examples disclosed herein may advantageously contribute toward a reaction zone, a reaction time, a reaction interval, a reaction energy or density, respectively, and/or other reaction parameters in the reactor or in the process device, respectively, in relation to known examples established or defined at a relatively lower tolerance or the reactor or the process device being conceived in a corresponding manner.

Figure 3:
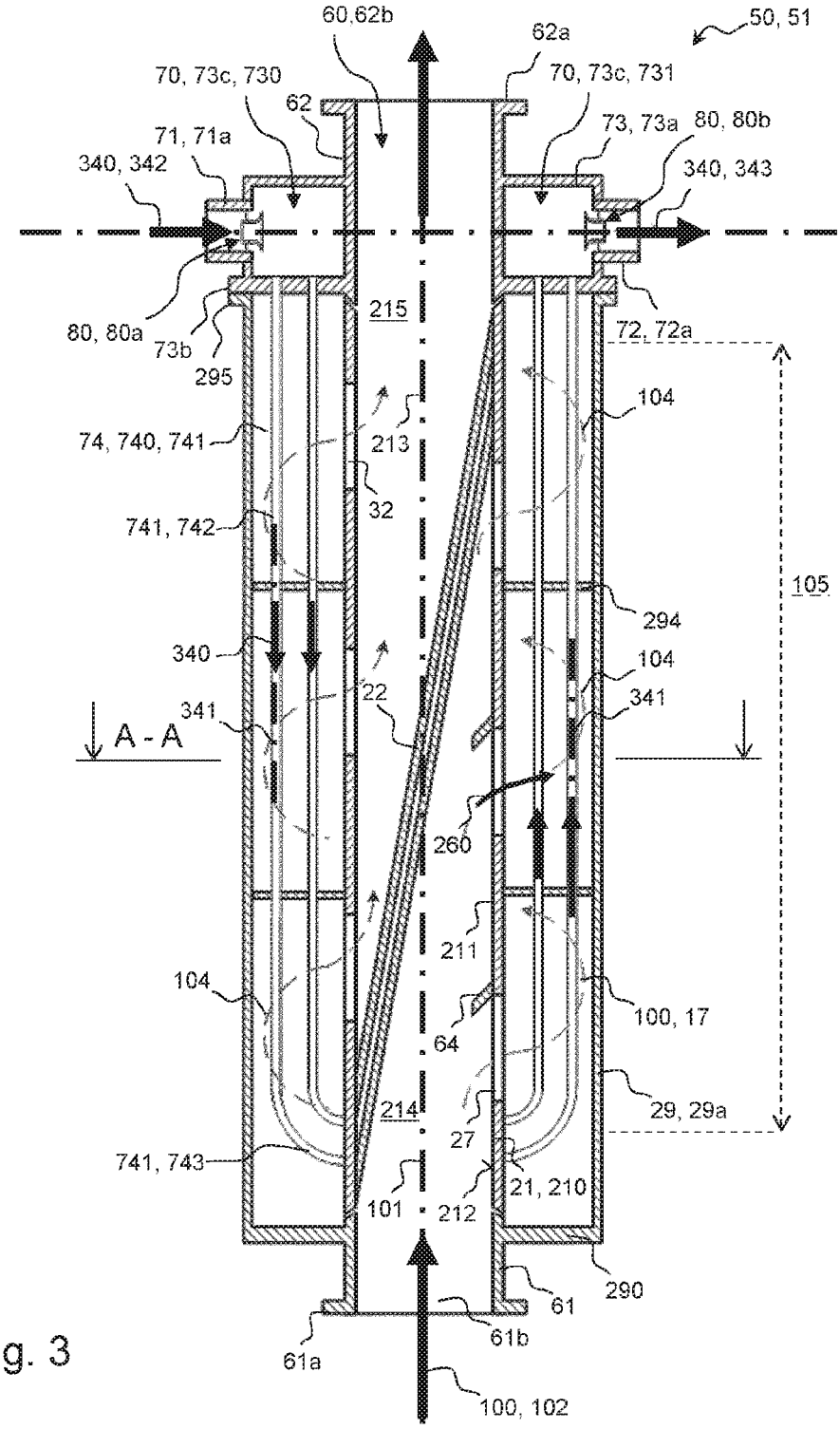
FIG. 3 illustrates a schematic longitudinal view of an exemplary embodiment of a flow device.

FIG. 3 shows a schematic longitudinal section through a flow device 50 according to the examples disclosed herein. As used herein, identical, similar or equivalent features of the example methods described herein retain their respective reference signs, while modifications or details of these features are provided with an index letter placed behind the numerical reference sign. The example flow device 50 of FIG. 3 is configured as an exemplary heat exchanger 51. Accordingly, the flow device 50, 51 substantially serves for exchanging or transferring thermal energy of a first fluid flow 100 to a second or a further fluid flow 340, respectively, or vice-versa. The first fluid flow 100 of the illustrated example corresponds to the fluid stream 10 flowing in the method, while the second or further fluid flow 340 may be assigned to the further fluid stream 34 of the previously described method.

As can be seen in the illustrated example of FIG. 3, the flow device 50, 51 includes a first line system 60 to conduct the first fluid flow 100, and a further line system 70 to conduct the further fluid flow 340 Each of the example line systems 60, 70 has one inflow-side entry connector 61, 71, and one outflow-side exit connector 62, 72. In this example, in relation to the fluid flows 100, 340, the entry connectors 61, 71 include inflow regions 61*b*, 71*b*. In an analogous manner, the exit connectors 62, 72 of the illustrated example include outflow regions 62*b*, 72*b* of the fluid flows 100, 340. In the illustrated example of FIG. 3, an entry flange 61*a* on the entry connector 61 of the first line system 60, and an exit flange 62*a* on the exit connector 62 are indicated in this example. By contrast, the connectors 71, 72 of the second line system 70 are illustrated as ports 71*a*, 72*a*. It is self-evident that in modifications thereof other line-connection points that are known to an ordinary person skilled in the art (e.g., fit connections, screw connections, soldered/brazed connections, and/or welded connections, etc.) or line-connection systems having interfaces thereof (e.g., bayonet system, profiled flanges, etc.) may also be provided in the region of the connectors 61, 62, 71, 72, for example.

The first line system 60 as per the illustrated example of FIG. 3 furthermore includes a guide pipe 21 that adjoins the entry connector 61, and extends in a substantially linear manner up to the exit connector 62 in this example. The guide pipe 21 according to the example is composed of an elongate hollow body 210, the jacket 211 of which by way of the internal face 212 to enclose the first fluid flow 100 in a substantially radial manner and axially guiding the latter. The hollow body 210 in this example is preferably a hollow cylinder, but may also be a hollow cone, a hollow pyramid, and/or any other hollow body that preferably has a main direction of extent such as an elongation, which is simultaneously a main axis 213 of the internal hollow space, the entry connector 61 and the exit connector 62 being disposed at the two ends of the latter, for example. Furthermore, in some examples, the inflow axis 102 and the outflow axis 103 are aligned to be preferably substantially parallel to the main axis 213 of the hollow space 210, in particular to be coaxial therewith, for example. By this example configuration of the first line system 60, an inflow axis 102 and an outflow axis 103 of the first fluid flow 100 are substantially aligned to be mutually parallel (e.g., mutually coaxial). The axes of the illustrated example in terms of the fluid stream 10 of the method as per FIG. 1 correspond to the inflow axis 14 and the outflow axis 15, respectively. In this example, the arrangement enables the particularly simple installation of the flow device 50 in a linear portion of an existing pipe system (for example a flue gas or an exhaust gas system, supply and/or disposal lines) that guides the first fluid flow 100 per se without relatively significant modifications or conversions having to be performed on the original system.

According to the illustrated example, the second line system 70 between the entry connector 71 and the exit connector 72 has a manifold 73 and a pipe-bundle system 74 that adjoins the manifold 73, communicating with the interior of the latter. The manifold 73 of the illustrated example of FIG. 3 is disposed in a radial manner about the exit connector 62 of the first line system 60. However, it may also be provided that the manifold 73 is to be disposed in the proximity of the entry connector 61, in particular in a radial manner about the latter, for example. Alternatively, in some examples, the manifold 73 may also be implemented as an axial add-on component, in particular disposed on the pipe jacket 29. In the example of FIG. 3, the example manifold 73 has a flange face 73*b* on which the pipe jacket 29, in the assembled state, is disposed and preferably fastened thereto using an assembly portion 295. The assembly portion 295 of the pipe jacket 29 in this example is preferably configured to provide a bearing face adapted to the flange face 73*b* (e.g., complementary to the flange face 73*b*). In some examples, the pipe jacket 29 is screwed. clamp-fitted, wedged, welded and/or soldered/brazed, adhesively bonded to the flange face 73*b* to provide the pipe jacket 29 for use during an operationally ready state of the flow device 50, 51, for example.

The manifold 73 of the illustrated example furthermore includes a manifold space 73*c*, the entry connector 71 and the exit connector 72 opening thereinto. In the example of FIG. 3, at least one entry chamber 730 and at least one exit chamber 731 are provided in the manifold space 73*c*. In some examples, the two chambers 730, 731 are each provided on one side of the exit connector 62, as is illustrated in a sectional manner. Alternatively however, the manifold 73 as shown in the example of FIG. 3 may also be configured as an annular system having at least two mutually separated chambers 730, 731 in the manifold 73.

In this example, the pipe-bundle system 74 in the operationally ready state of the flow device 50 has a main axial direction extending along the direction 101 of the inflow axis 102 and the outflow axis 103 of the first fluid flow 100, or in the direction of the main direction corresponding to an extent of the guide pipe 21, respectively. The second fluid flow 340, after entering into the second line system 70, flows into the entry chamber 730 of the manifold 73. From the entry chamber 730, the fluid flow 340 enters into the pipe-bundle system 74, where subdividing the fluid flow 340 into part-flows (e.g., partial flows) by pipe bundles 740, which in an analogous manner, communicate in parallel with the entry chamber 730, or by pipe loops 741, may advantageously be provided. In the illustrated example of FIG. 3, an operationally parallel arrangement of two pipe loops on the manifold is illustrated. Depending on the application, the number of pipe loops may vary; in particular, an advantageous choice may result based on the flow rates and/or required flow velocities or flow parameters or reciprocal-action parameters in conjunction with other conceptual variables of the pipe loops (for example internal diameter, wall thickness, required spacing of adjacent pipe loops, length of the pipe loops, etc.). In the present example as per FIG. 3, the pipe loops 741 couple the entry chamber 730 to the exit chamber 731 such that the second fluid flow 340 by respective part-flows may flow from the entry chamber 730 to the exit chamber 731 through the respective pipe loop 741. For example.

The pipe loops 741 as illustrated in FIG. 3 have two substantially linear legs 742 and one reversing portion 743. A sum of the lengths of the legs 742 is preferably greater than that of the reversing portion 743, in particular is at least twice, preferably at least three times, particularly preferably at least four times as long as the latter. In the operational state of the flow device 50 the legs 742 according to FIG. 3 are aligned so as to be substantially parallel with the main axis 213, on account of which a main flow axis 341 of the second fluid flow 340, or of the part-flows thereof, respectively, in the second line system 70 is oriented so as to be parallel with the inflow axis 102 and the outflow axis 103 of the first fluid flow 100. In addition to the parallel and linear embodiment of the pipe loops 741 as illustrated in FIG. 3, it may be advantageous for the pipe loops 741, for example along the main flow axis 341, to be embodied in a twisted or stranded manner, respectively.

In the preferred example shown in FIG. 3, the entry connector 71, 71*a* and the exit connector 72, 72*a* of the second line system 70 are disposed on mutually opposite lateral faces of the manifold 73. The connectors 71, 72 of the illustrated example are preferably provided to lie in one plane on the manifold 73, where the former are aligned in particular to be mutually parallel, particularly preferably to be mutually coaxial. The flow axes resulting from the connectors 71, 72 in this example are, likewise, preferably parallel, and preferably coaxial. In the example of FIG. 3, these flow axes of the connectors 71, 72 are substantially perpendicular to the outflow axis 103 of the first fluid flow 100, or of the outflow connector 62, respectively. Depending on the type of application, it may however also be advantageous for the connector 61 or 62 in relation to the connectors 71, 72 to be substantially aligned at an angle that is not equal to zero, for example.

In the present example of a flow device 50, 51 according to the examples disclosed herein per FIG. 3, in each example, one optional flow body 80 is provided both in the flow region of the entry connector 71 and in the flow region of the exit connector 72 of the second line system 70. The flow bodies 80 of this example reduce a tendency toward turbulence of the inflowing or outflowing fluid flow 340, respectively, by suitably guiding the flow. The inflow-side flow body 80*a* of the illustrated example facilitates the transfer of the inflowing fluid 340 from the line cross section of the entry connector 71 into the entry chamber 730 while the outflow-side flow body 80*b* supports the discharge of the fluid flow 340 from the exit chamber 731 into the line cross section of the exit connector 72.

As indicated in the illustrated example FIG. 3, the flow bodies 80, 80*a*, 80*b* have at least one directional portion 81, which at least partially deflects the fluid flow 340. As is shown in FIG. 3, the directional portion 81 may be configured to be symmetrical, in particular mirror-symmetrical or rotationally symmetrical relative to the main flow axis 341, in particular relative to an inflow axis 342 or an outflow axis 343. However, in some examples, depending on the locally arising flow characteristics, it may be advantageous for the directional portion 81 to have a non-symmetrical design. Furthermore, in the example of FIG. 3, the example flow bodies 80*a*, 80*b*, at least in terms of the design of the directional portions 81, thereof, are of substantially identical design and/or geometry, thereby advantageously reducing, in particular, the number of dissimilar assembly elements to be joined together and during maintenance. However, should dissimilarities between the flow profiles of the entry chamber 730 and the exit chamber 731 arise, it may be advantageous for the flow bodies 80, 80*a*, 80*b* to be provided with mutually deviating designs, in particular with mutually deviating directional portions 81.

In order to be arranged in the line portions of the line system 70, the flow body 80, 80*a*, 80*b* preferably has an arrangement portion 82. In some examples, the latter may be configured as a press-fit portion, in particular as a press-fit cone, as a clamp-fit portion, or as a clamp-fit cone that is adapted to the line cross section of the respective line portion present at the assembly site. According to the illustrated example, the press-fit or clamp-fit connections may be readily employed when the geometry of the line cross section at the envisaged assembly site does not become excessively complex, and instead follows a relatively simple geometry (e.g., a circle, an ellipse, a triangle, a square). Additionally or alternatively, another form-fitting connection technique may be employed on the arrangement portion 82, such as, for example, a clip-type connection to surface structures such as protrusions, undercuts, or the like, which in the region of the assembly site are present in the line system 70 or are subsequently attachable thereto or introducible therein. Additionally or alternatively, a materially integral connection such as, in particular, a releasable materially integral connection, by means of adhesive bonding, soldering/brazing, and/or welding, would also be conceivable for assembling the flow body 80 in the line system 70.

Some potential examples of flow bodies 80 are described below in connection with FIGS. 4*a* to 4*c*, which are depicted as cross sections.

Figure 4A:
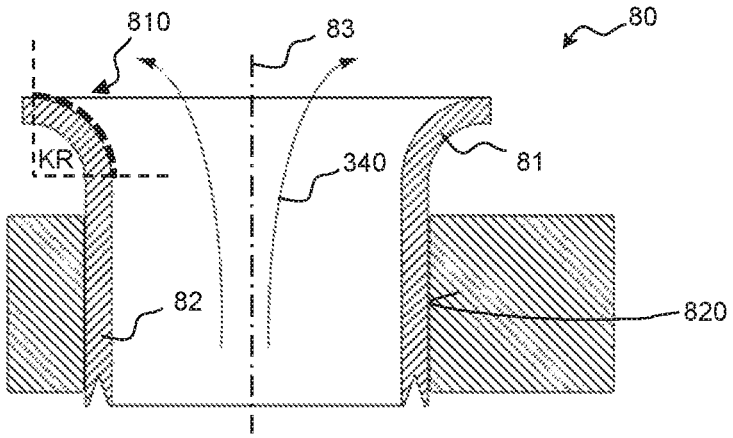
FIG. 4*a* shows a first example flow body.

An example flow body 80 is shown in FIG. 4*a*. The flow body 80 of the illustrated example is configured as a sleeve, where the directional portion 81 transitions to the arrangement portion 82, where the former is integrally embodied with the latter, and where the portions 81, 82 need not necessarily be composed of one and the same material. In some examples, it is conceivable that dissimilar materials may be chosen, depending on the capabilities and/or properties of the materials. Accordingly, the example arrangement portion 82 may be manufactured from a material that is particularly suitable for establishing a connection (e.g., from a metal, a metal alloy, a plastic material and/or a composite material), while the directional portion 81 may be composed of a material that is particularly suitable for the inflow of a fluid flow and/or for forming or shaping to establish the directional geometry (e.g., from a metal, a metal alloy a plastics material, a composite material, and/or from ceramics), where the properties of the fluid flow acting on the flow body during operation and the environmental parameter may be considered in the choice of the materials. If and when the two portions 81, 82 are composed of dissimilar materials, the latter for an example as shown in FIG. 4 are interconnected, where the ordinary person skilled in the art will choose a connection technique that is known to him or her as being suitable for the materials used. An example flow body 80 as shown in FIG. 4*a* may be particularly readily manufactured from a continuous material. In such a manner, the flow body 80 of FIG. 4*a* may be manufactured by forming a sheet-metal panel, by forming via sintering, by metal die casting, by plastic injection molding, or by any appropriate method. In the example of forming a sheet-metal panel, a bi-component type example for the two portions 81, 82 is conceivable by utilizing a bi-metallic sheet metal panel as a primary material.

In the example shown in FIG. 4*a*, the arrangement portion 82 is shown as a substantially cylindrical sleeve body that is introduced into the line cross section of the line system at the assembly site. In such examples, a particularly simple assembly is possible at the assembly site by a clamp-fit or a press-fit connection, for example, between an external surface area 820 of the arrangement portion 82 and an internal wall of the line system. In some examples, if the flow bodies 80 are disposed on the assembly locations thereof in the flow device 50 to be releasable, the former in the context of maintenance measures may moreover be readily removed, cleaned, and/or replaced. In some examples, the directional portion 81, which is likewise in the manner of a sleeve in an exemplary manner, is configured as a diffusor cone 810 that opens towards the direction away from the arrangement portion 82. In the example shown in FIG. 4*a*, the diffusor cone 810 across the length of the curvature has a substantially constant curvature radius, which is denoted by KR, and which in relation to a central axis 83 is substantially symmetrical. However, in some examples, it may be advantageous for the curvature radius, KR, to be configured to not be constant and/or symmetrical.

According to the illustrated example of FIG. 4*a*, a flow body 80 may also be advantageously utilized to subsequently establish a rounded transition edge on the cross-sectional steps in line systems. This is of advantage when direct rounding on the lines in the region of the cross-sectional step is not possible or possible only with difficulty, and/or when an optimal rounding profile during operation of the respective line system is not known or determinable in advance.

Figure 4B:
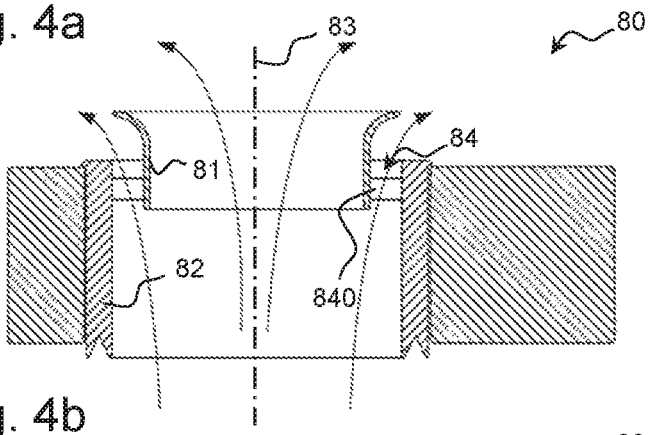
FIG. 4*b* shows a second example flow body.

FIG. 4*b* shows an extended embodiment of a flow body 80 in which the directional portion 81 is connected (e.g., is mounted thereon) to the arrangement portion 82 by a support structure 84. The arrangement portion 82 of the illustrated example is embodied in an analogous manner to the example of FIG. 4*a* as a substantially cylindrical sleeve body that in a relatively simple manner enables a clamp-fit or press-fit connection between an external surface area 820 of the arrangement portion 82 and an internal wall of the line system at the assembly site.

In this example, the directional portion 81 by bridge-type connections of the support structure 84 is coupled to the arrangement portion, in particular disposed to be aligned therewith. The arrangement of the connection bridges 840 of the support structure 84 on the arrangement portion 82 is preferably performed on an internal surface area 821, but may also be provided on at least one end side 822 of the arrangement portion 82, for example. In some examples, the arrangement of the connection bridges 840 of the support structure 84 on the directional portion 81 is preferably performed on an external wall 811.

Figure 5:
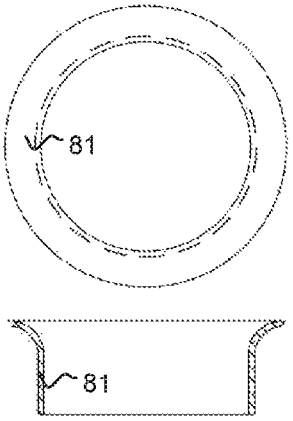
FIG. 5 shows two views of the first exemplary embodiment of a flow body per FIG. 4*b*.

The directional portion 81 per se in turn is configured in the manner of a sleeve, where the embodiment that is separated from the arrangement portion 82 in relation to the embodiment of FIG. 4*a* allows the person skilled in the art an advantageously enhanced freedom of design (e.g., in terms of the choice of a wall thickness, of a more complex shaping, and/or of an enhanced degree of freedom in the choice of the material because there are fewer restrictions by virtue of the connection technique). In particular, an example in which the flow-conducting properties of the directional portion 81 vary depending on flow parameters (e.g., pressure, temperature, and/or flow velocity, composition, etc.), may also be considered. In such a manner, a bi-metallic embodiment of a directional portion 81 could vary the curvature radius depending on the temperature, for example. The configuration of surface structures that are deformable in a pressure-sensitive manner may also be of advantage. In the example of FIG. 4*b*, a wall thickness of the directional portion 81 in relation to the wall thickness of the arrangement portion 82 is significantly reduced, for example. Accordingly, FIG. 5 shows two projected views from two viewing directions of an exemplary and rotationally symmetrical embodiment of a directional portion 81 as per FIG. 4*b*.

In one example modification of a flow body 80 per FIG. 4*b*, the directional portion 81 may also be configured as a mesh-type structure of directional vanes, for example. Also, a nesting of a plurality of directional portions 81, which by the support structure 84 are connected to the arrangement portion 82, is also conceivable, where said nesting running toward the central axis 83, where the directional portions 81 that are nested in this way in terms of the axial position thereof in relation to the sleeve of the arrangement portion 82 may differ from one another, and/or may differ in terms of the geometry, structure, and/or materials thereof. By this diversity of design parameters, flow bodies 80 that in terms of their influence on the flow are particularly effective may be produced, and which may be employed in particular in the case of a strong tendency toward turbulence of a line system in the original state, that is to say without this additional measure.

Figure 4C:
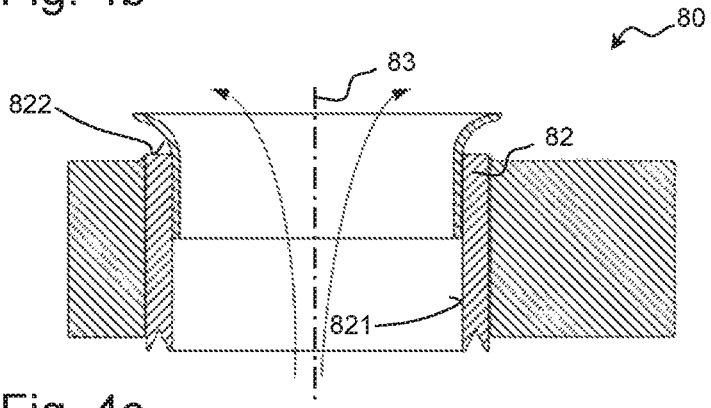
FIG. 4*c* shows a third example flow body.

FIG. 4*c* shows a third example variant of a flow body 80, in which a support structure 84 as shown in the preceding example is dispensed with. Rather, in this example, a sleeve-type directional portion 81 that is configured in an analogous manner to that of the previous example is disposed directly on the internal surface area 821 of the arrangement portion 82, or is connected thereto, respectively. In some examples, a clamp-fit or a press-fit connection between the external wall 811 of the directional portion 81 and the internal surface area 821 of the arrangement portion 82 may be provided. Alternatively or additionally, other joining techniques, such as adhesive bonding, soldering/brazing, welding, clip-fitting, or latching, or else screwing or pinning, may also be employed, however.

The examples of flow bodies 80 shown in FIGS. 4*a*-4*c* represent only examples of these means for optimizing flow profiles. By combining the individual features disclosed in detail in the examples, a person of ordinary skill in the art will readily arrive at modified embodiments of flow bodies 80 having a suitable directional portion 81, which however ultimately have similar effect(s).

Apart from the two flow bodies 80, 80*a*, 80*b*, which are specifically provided in FIG. 3, it may furthermore be advantageous for the operation of a flow device for analogous flow bodies 80 to be further disposed in other line regions of a line system, in particular having a cross-sectional variation and/or a flow deflection. In the flow device 50, 51 as per the illustrated example of FIG. 3, flow bodies 80 are only in the region of the entry connector 71 and of the exit connector 72. Additionally or alternatively, however, similar flow bodies 80 may also be provided at or disposed on, respectively, other suitable points of the line systems 60, 70 of the flow device 50, 51. In this manner, the transitions between the entry chamber 730 and the exit chamber 731, respectively, and the pipe-bundle system 74 may be improved and/or optimized in terms of flow technology by a corresponding arrangement of flow bodies 80, for example.

The configuration of flow bodies 80 as a functional group that is initially independent from the target line system furthermore enables flow devices (e.g., heat exchangers, evaporators, boilers, etc.) and/or line systems that have already been installed to be optimized in terms of flow technology by retrofitting flow bodies 80. In this manner, retrofit flow bodies 80 of this type would be providable as pre-fabricated units for standardized line sizes and also be advantageously exploitable independently of the flow device according to the examples disclosed herein.

Following the detailed discussion relating to details of the flow bodies 80, 80*a*, 80*b*, the focus shall return to the further construction of the flow device according to FIG. 3.

A hood-type pipe jacket 29 is disposed in the example of the flow device as shown in FIG. 3 so as to be adjacent to the manifold 73. The pipe jacket 29 in this example extends at least along the main axis 213 of the first line system 60, thereby covering or spanning, respectively, at least the pipe-bundle system 74 of the second line system 70. The intermediate space 30 which, thus, results between the guide pipe 21 and the pipe jacket 29, at an end which faces away from the manifold 73, is closed off by a base 290, for example. The pipe loops 741 of the illustrated example extend through this embodiment into the intermediate space 30. For the pipe loops 741 in the extent thereof through the intermediate space or interior 30, to be able to be exposed to at least limited guiding and/or positional stabilization, at least one, preferably a plurality of stabilizers 294 is/are provided in the pipe jacket 29, for example. In some examples, the stabilizer 294 may be configured as a mesh structure and/or a support structure through which the pipe loops 741, in particular individual pipelines of the pipe-bundle system 74 may engage and, thereby, at least in one spatial direction are guided, supported, and/or secured against displacement from the rest position of the former.

According to the illustrated example of FIG. 3, a partition wall 22 is disposed in the interior of a portion of the guide pipe 21 that is enclosed by the pipe jacket 29. The partition wall 22 in this example separates an inflow-side region 214 of the guide pipe 21 that emanates from the entry connector 61 from an outflow-side region 215, which leads to the exit connector 62. The partition wall 22 of the illustrated example of FIG. 3 is embodied as a substantially linear planar wall that is disposed in the interior in such a manner that a cross-sectional area of the interior of the inflow-side region 214 of the guide pipe 21, as the spacing from the entry connector 61 increases, decreases at almost the same rate at which a cross section of the outflow-side region 215 increases. As is illustrated in FIG. 3, this is achieved in a particularly simple manner by tilting the partition wall 22 in at least one axis that is substantially perpendicular to the main axis 213. Deviating from the embodiment shown in FIG. 3, it may also be advantageous for the partition wall 22 to also be tilted in a second axis that is perpendicular to the main axis 213 and/or for the partition wall 22 to be configured or shaped not to be linear but to follow a two-dimensional profile (e.g., in flat steps, in angled steps, parabolic, hyperbolic, or the like, etc.), in particular to follow a two-dimensional profile that is dependent on the axial position along the main axis 213 such that the cross section in the inflow-side region 214 and/or the outflow-side region 215 may be a more complex function of the position along the main axis 213.

In the example of FIG. 3, the partition wall 22 is embodied in a double-walled manner as a component part of the guide means 20. In this example, a first wall segment 220 is advantageously in connection to the inflow-side region 214 of the jacket 211, or of the guide pipe 21, respectively, while a second wall segment 221 is connected to the outflow-side region 215, for example. An insulation 223 between the wall segments 220, 221 may additionally be provided in an intermediate space 222. On account thereof, it may be advantageously ensured that an inflow portion 120 of the first fluid flow 100 may come into reciprocal action with an outflow portion 130 of the latter in a reduced manner (e.g., as little as possible). This could have a disadvantageous effect in particular in an embodiment as a heat exchanger 51 of the flow device 50 since the partition wall 22 without insulation may act as a thermal short circuit between an inflow and an outflow of the first fluid flow 100. In some examples, the insulation 223 may be achieved by a suitable insulation or proofing material having a low thermal conductivity (e.g., a thermal conductivity as low as possible), a sealing tape, and/or inclusion of an evacuated region in the intermediate space 222.

According to the illustrated example, in the portion thereof that is enclosed by the pipe jacket 29, the guide pipe 21, in particular the jacket 211, both in the inflow-side region 214 as well as in the outflow-side region 215, in each case has at least one radial passage 27, 32. In the example of FIG. 3, three radial passages 27 are provided along the inflow-side region. In an analogous manner, according to FIG. 3, three radial passages 32 are likewise provided in the outflow-side region 215. However, in some examples and/or applications, there may be advantages in providing more or fewer radial passages 27, 32 and/or mutually dissimilar numbers of radial passages 27, 32.

In this example, the first two radial passages 27 along the inflow axis 102 as shown in FIG. 3 are additionally each provided with one flow guide body 64. In the example of FIG. 3, the latter disposed along the inflow axis 102 to be axially behind the respective radial passages substantially extending into the interior of the guide pipe 21 The flow guide bodies 64 of the illustrated example facilitate a subdivision of the first fluid flow 100 by the arrangement according to the examples disclosed herein of the partition wall 22, into radial part-flows 260 which pass through the respective radial passages 27, in particular to mutually substantially homogenize the part-flows 260. The illustration in FIG. 3 is to be understood only as an example. As a result, the provision of flow guide bodies 64 under certain circumstances may have advantageous effects on all or at least on another selection of radial passages 27, 32. Moreover, the arrangement of the flow guide bodies 64 in relation to the respective assigned radial passage 27, 32 may deviate from the example illustrated in of FIG. 3, where the axial position along the radial passage 27, 32, the radial extent, in particular the direction of extent of the flow guide body 64, the geometric shape, and/or an axial extent (for example in the form of a mesh) offer freedom for improvement and/or optimizations, for example, in the respective type of application of a flow device 50 according to the examples disclosed herein.

Additionally or alternatively, the flow guide bodies 64 may also serve as means for setting the rotation direction of the part-flows 260 in the circulation-flow portion 17, for example. Additionally or alternatively, the radial passages 27 per se may also be embodied such that part-flows 260 passing therethrough are aligned so that they follow a fixedly chosen rotation direction in the circulation-flow portion 17. In these examples, the radial passages 27 may also act as means for setting the rotation direction. Additionally or alternatively, suitable deflection bodies on an internal side of the pipe jacket 29 that is substantially opposite the radial passages 27 may also be provided as means for setting the rotation direction of the part-flows 260.

The mode of functioning of a flow device 50 according to the examples disclosed herein is now to be explained in conjunction with a particularly advantageous exemplary application as a heat exchanger 51 to exchange thermal energy between a first fluid flow 100, which is carrying thermal energy, and a second fluid flow 340, which is absorbing thermal energy. An example as shown in FIG. 3 is particularly suitable for a relatively large-volume fluid flow 100 with a thermal transfer to a second fluid flow 340 with a relatively lower volumetric flow. Applications of this type are to be found, for example, in pre-heaters and/or evaporators in thermal power plants according to the Rankine cycle, in particular, plants for recovering and converting energy to electrical energy from heat-conducting fluid flows 100 (e.g., flue gases or exhaust gases from industrial processes, geothermally and/or solar-thermally heated fluid flows, etc.).

In this example, the heat-absorbing fluid flow 340 (e.g., an operating fluid of a thermal power plant, in particular an organic operating fluid of an ORC plant, etc.) is supplied through the entry connector 71 of the second line system 70 to the flow device 50, flowing from the entry chamber 730 via the pipe-bundle system 74 and extending into the intermediate space 30 to the exit chamber 731.

According to the illustrated example, the heat-conducting fluid flow 100 (for example hot flue gas and/or exhaust gas), in turn, is supplied by the entry connector 61 in the inflow region 61*b* of the first line system 60 of the flow device 50. The fluid flow 100 of the illustrated example then expands along the inflow axis 102 in the inflow-side region 214 of the guide pipe 21, and in a reciprocal action with the partition wall 22, is deflected and subdivided into radial part-flows 104. In this example, the part-flows 104 enter into the intermediate space 30 through the inflow-side radial passages. In the intermediate space 30, each of the part-flows 104 are in deflected to form a circumferential flow along the circumferential line 18, or along circumferential lines 18 that are substantially parallel, respectively, where each part-flow 104 has a circulation-flow portion 17. In this example, the entire region of the circulating part-flows 104 may be referred to as the circulation-flow region 105, for example.

The part-flows 104 of the illustrated example move in a circulating manner flow about the pipe bundles 740 or the pipe loops 741, of the pipe-bundle system 74, respectively, in a direction that is transverse to a running direction of the pipe-bundle system 74, in particular transverse to the legs 742 of the pipe loops 741. On account thereof, the second fluid stream 340 or the proportions thereof flowing through the pipe loops 741, respectively, are subject to an essentially transverse inflow by the part-flows 104 such that a thermal transfer in the contact zones formed hereby is locally increased and/or optimized.

In one preferred example of the flow device 50 according to the examples disclosed herein as an evaporator of an energy conversion plant according to the Rankine cycle, in particular an ORC plant for example, the operating medium is directed through the pipe-bundle system 74 in such a manner that the part-flows 104 of the heat-conducting fluid flow 100 may transfer a relatively large amount of heat to the operating medium that the operating medium may, preferably, almost entirely be converted from a liquid phase to a vapor phase or a gas phase, for example.

Figure 6:
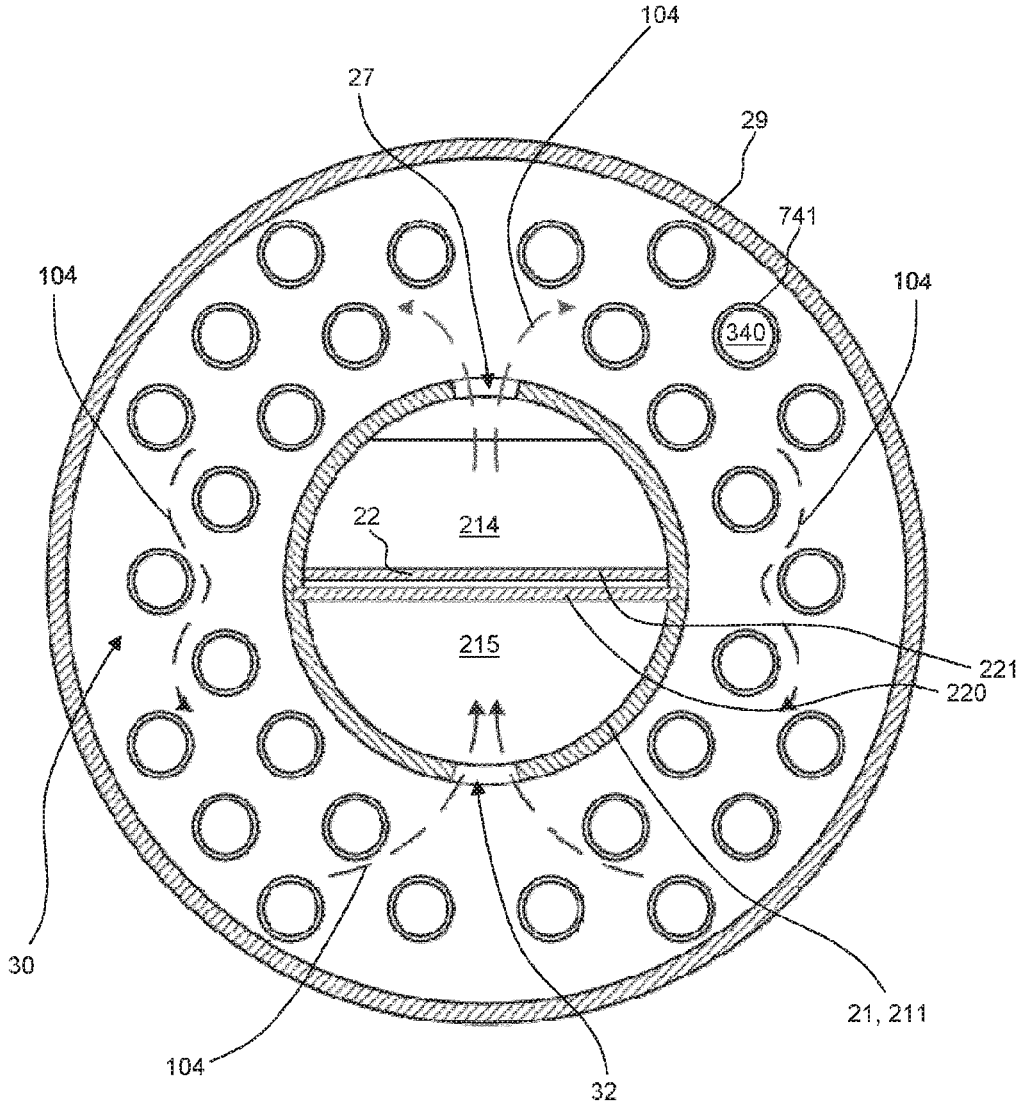
FIG. 6 shows a cross section through the example of FIG. 3 along the line A-A.

In some examples, in order for this procedure to be implemented, FIG. 6 shows a section through the flow device 50 of FIG. 3, along the line A-A of FIG. 3. As can already be seen in FIG. 3, the radial passages 27 and the radial passages 32 in the present example are disposed on sides of the guide pipe that are substantially mutually opposite. This is shown in greater detail in FIG. 6. In this example, each part-flow 104 circulates or revolves, respectively, about the guide pipe 21 and, thus, about the inflow axis 102 and the outflow axis 103, respectively, of the heat-conducting fluid flow 100 at a circumferential angle, UW, of approx. 360°, for example.

According to the illustrated example, having passed or covered this circumferential angle, respectively, the part-flows 104 at the radial passages 32 enter into the outflow-side region 215 of the guide pipe 21. According to FIG. 3, the part-flows 104 are deflected in the axial direction again, and brought together. In particular, the fluid flow 100 that has been brought together in this manner and which by heat transfer to the second fluid flow 340 has been "cooled," leaves the flow device 50 via the exit connector 62. In some examples, the fluid flow 100 may also be subjected to a subsequent process (e.g., post-filtering, cleaning, and/or further heat exchanging and/or treatment), or supplied to a corresponding device (e.g., a heat exchanger, a cleaning, filtering, washing installation, and/or a funnel).

Figure 7A:
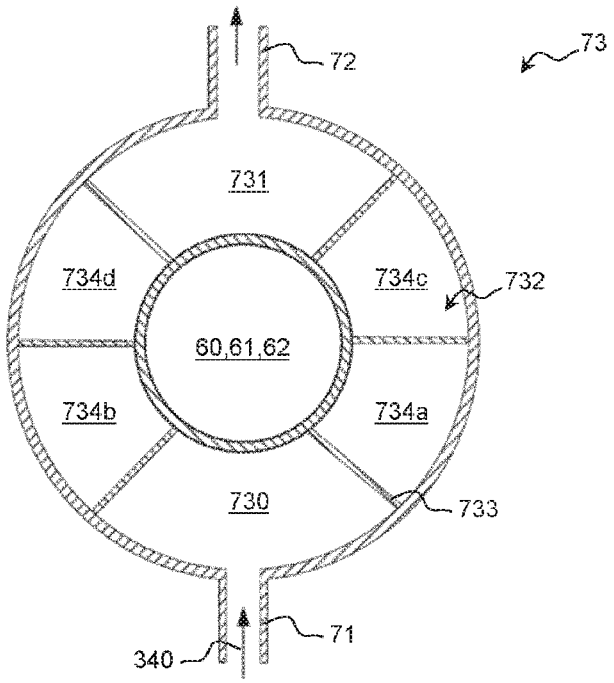
FIG. 7*a* shows a cross-sectional view of a first example of a manifold of an example flow device similar to the example flow device of FIG. 3.
Figure 7B:
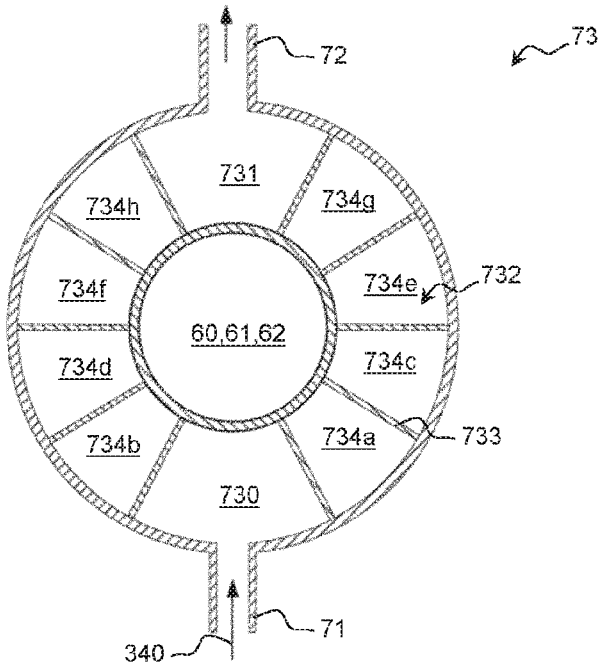
FIG. 7*b* shows a cross-sectional view of a second example of a manifold of a flow device similar to the example flow device of FIG. 3.

As has been described above, one preferred refinement of the example flow device 50, 51, as shown in FIG. 3, may lie in a construction of the manifold 73 in multiple segments such that multiple passes of the second fluid flow 340 conducted through the intermediate space 30 are enabled. FIGS. 7*a* and 7*b* show two preferred variants of the manifold 73 per FIG. 3 as a projected view of the end side.

According to the example of FIG. 3, the manifold 73 is configured as an annular duct 732 that extends about the first line system 60, in particular about the exit connector 62. Alternatively, in some examples, the manifold 73 may also be disposed about the entry connector 61 of the first line system 60. The entry chamber 730 and the exit chamber 731 are disposed on mutually opposite sides to be mutually separated by partition walls 733, for example. In this example, each of the entry chamber 730 and the exit chamber 731 are positioned/formed in the annular duct 732 in the circumferential direction about the exit connector 62 by two partition walls 733 that are mutually spaced apart at an angular distance. The entry chamber 730 and the exit chamber 731 of the illustrated example are of a substantially identical cross section in the projected plane shown. Preferably, in some examples, an internal volume of the entry chamber 730 and the exit chamber 731 are substantially identical.

In contrast to the examples shown herein, it may however also be advantageous for the cross sections and/or the internal volumes of the entry chamber 730 and of the exit chamber 731 to be embodied in a mutually deviating manner. For example, if and when the flow device 50 is employed as an evaporator, a volumetric flow of the second fluid flow 340 typically increases between the entry chamber 730 and the exit chamber 731. For example, for the pressure conditions in the flow device 50, in particular in the second line system 70, not to be unfavorably influenced, the exit chamber 731 may have an internal volume that in relation to that of the entry chamber 730 may be enlarged. Alternatively, if and when the flow device 50 is employed as a condenser, it may conversely be advantageous for the internal volume of the exit chamber 731 to be reduced relative to the internal volume of the entry chamber 730. Moreover, further applications and uses of the flow device 50 according to the examples disclosed herein, respectively, which facilitate or require cross sections and/or volumes which are mutually deviating between the entry chamber 730 and the exit chamber 731 are known to a person of ordinary skill in the art.

In the embodiment corresponding to FIG. 7*a*, in each example, one further partition wall 733 is furthermore disposed in both rotation directions about the exit connector 62 between the entry chamber 730 and the exit chamber 731 in such a manner that in for each, two additional intermediate chambers 734, 734*a* to 734*d* are formed/positioned in the annular duct. The intermediate chambers 734*a* to 734*d* of the illustrated, in the projected plane shown in FIG. 7*a*, preferably have an identical cross section. Particularly preferably, in some examples, an internal volume of the intermediate chambers 734, 734*a* to 734*d* is substantially identical.

By way of the construction of the manifold 73 as shown in the illustrated example of FIG. 7*a*, a construction of the second line system 70 with six passes may be implemented in a simple manner. To this end, the entry chamber 730 by way of a first set of pipe loops 741, 741*a* is connected to one of the two intermediate chambers 734*a*, 734*b* such that part-flows of the second fluid flow 340 that is supplied by the entry connector 71 may flow from the first pipe loop set 741*a* into one of the two intermediate chambers 734*a*, 734*b*. In some examples, the part-flows as shown in FIG. 3 at this first stage twice have already passed twice through the intermediate space 30. In this example, each of the intermediate chambers 734*a*, 734*b* by which one part-set of pipe loops 741*b* is further connected to each one of the intermediate chambers 734*c*, 734*d* such that the part-flows in this stage may again twice pass through the intermediate space 30. Finally, in this example, each of the intermediate chambers 734*c*, 734*d* by a further part-set of pipe loops 741*c* is connected to the exit chamber 731, based on the part-flows twice flowing through the intermediate space 30 one last time. Thus, in some examples, each part-flow of the fluid flow 340 runs through the interior 30 between the entry chamber 730 and that of the exit chamber 731 for a total of six times. In other words, in these examples, six passes of the fluid stream 340 through the interior 30 are performed.

In the example shown in FIG. 7*b*, a total of three partition walls are disposed between the entry chamber 730 and the exit chamber 731 in each rotation direction about the exit connector 72. On account thereof, in an analogous manner to the example of FIG. 7*a*, a total of four pairs of intermediate chambers 734*a* to 734*h* are formed. It is also provided in this example that adjacent chambers 730, 734*a*, 734*c*, 734*e*, 734*g*, 731 are successively connected by sets or part-sets, respectively, of pipe loops 741*a*, 741*b*, 741*c*, 741*d*, and 741*e*. In this manner, the part-flows of the fluid flow 340 pass through the intermediate space 30 a total of ten times in this example. In other words, in this example, ten passes of the fluid stream 340 through the intermediate space 30 are performed.

The embodiments of circuit diagrams of the second line system 70 via the manifold 73, as shown in FIGS. 7*a* and 7*b* and described above, are understood to be examples as preferred embodiments. Other circuit diagrams of the entry chamber 730, the intermediate chambers 734 and/or the exit chamber 731 may also result in other advantageous arrangements. The number of intermediate chambers 734 may also deviate from the examples shown; it would also be conceivable, in particular, for the number and/or the embodiment of intermediate chambers 734 along the two rotation directions about the connector 62 or 61 to be mutually deviating, so as to enable an advantageous configuration.

Apart from the example as shown in FIG. 3 and the example variants of the second line system 70 as a pipe-bundle system 74 having pipe loops 741 described in this context, the flow device 50 according to the examples disclosed herein in a variant may be implemented having substantially linear pipe lengths. In these examples, the pipe lengths like the pipe loops 741 are connected to the manifold 73, in particular to the annular duct 732 thereof, and extending into the intermediate space 30. In some examples, the pipe lengths preferably traverse the intermediate space 30 in such a manner that the former at an end which is remote from the annular duct 732 open into a collection duct. To enable an outflow of the fluid flow 340 flowing into the collection duct, the collection duct may be connected to the exit chamber 731 as well as comprise at least one dedicated exit connector which then preferably forms the exit connector 72 of the second line system 70. In the example of a second line system 70 that is constructed from pipe lengths of this type, a particularly preferred refinement of a manifold 73 is disclosed. In particular, the latter has a closure lid 73*a* that releasably closes off the annular duct 732 toward one end side based on the annular duct 732 for maintenance purposes and/or for adaptations may advantageously be opened and closed again. The closure lid 73*a* of the illustrated example may be implemented as a screw-on lid and/or may be implemented having another closure mechanism, such as a screw connection, a clamp-fit or wedge-fit mechanism, or the like, for example. Moreover, a releasable closure lid 73*a* permits the partition walls 733 to be embodied so as to be replaceable and/or to be displaceable in the rotation direction in the annular duct. If the partition walls 733 are displaced and/or in their number are varied between the entry chamber 730 and the exit chamber 731, the design embodiment and/or the number of intermediate chambers 734 may, accordingly, be varied. On account thereof, a pass rate or a number of passes, respectively, of the second fluid flow 340 through the intermediate space 30 in the second line system 70 of the flow device 50, 51 may advantageously be adapted. However, in some examples, a closure lid 73*a* which is releasable for maintenance purposes may also be advantageous in the case of manifolds 73 such as those shown in the exemplary flow device 50 of FIG. 3.

Figure 8:
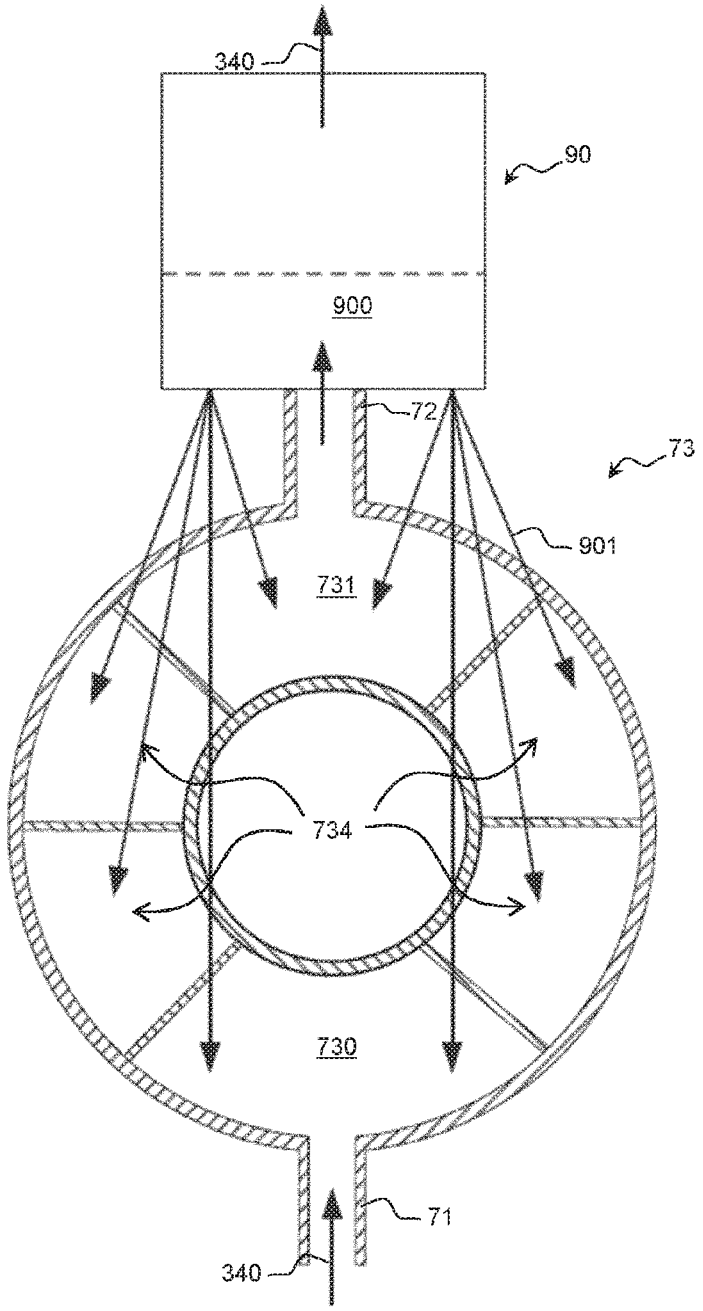
FIG. 8 shows a manifold of FIG. 7*a* with a droplet separator.

One advantageous refinement of a flow device 50, 51 according to the examples disclosed herein, as shown in FIG. 3, is roughly outlined in FIG. 8. According to the illustrated example, an example separation apparatus 90 is disposed on the exit connector 72 of the second line system 70, in particular on an adjoining outflow portion 735 of the exit chamber 731. In one preferred example, the separation apparatus 90 is implemented as a droplet separator. A droplet separator 90 that is disposed on or integrated in the manifold 73, or is at least operatively connected to the exit chamber 731, may be advantageous in particular when the flow device 50, 51 is employed as an evaporator for the second fluid flow 340, for example. It may arise in some examples that the second fluid flow 340, which in the entry chamber 730 is substantially liquid, in the course of the passage of the former through the second line system 70, in particular through the intermediate space 30, is converted only partially (e.g., not entirely) from a liquid phase to a vapor phase. For example, it may arise that a second fluid flow 340 exiting the exit chamber 731 entrains at least liquid proportions (e.g., in the form of droplets) that may have a disruptive effect on downstream processes or apparatuses. These effects may be precluded if the manifold 73 of the flow device 50, 51 is implemented according to FIG. 8, for example.

Disposing the separation apparatus 90 on the manifold 73, or integrating the former therein, enables an advantageously simple return of the separated material, in particular of the condensate, or of the residual liquid, respectively, to at least one of the chambers 730, 734. In one example, a separation space 900 is or can be connected to the entry chamber 730 and/or an intermediate chamber 734 by the way of at least one return line 901. The return may be effected by simple utilization of gravity and/or by a special design embodiment of the return line 901. In particular, the separation space 901 by the return line 901 may be connected to the chamber 730, 734 in such a manner that the separated material, in particular the condensate, or the separated residual liquid, respectively, may flow back into the latter. The return line of these examples may preferably be configured such that the separated material, in particular the condensate, or the separated residual liquid, respectively, by the flow of the fluid flow 340 into the chambers 730, 734, or therethrough, respectively, is pushed or suctioned into the chamber 730, 734 that is connected by the return line. Alternatively or additionally, the separation apparatus 90 may include a return apparatus (e.g., a pump or the like, etc.) that provides the separated material from the separation space 900 via the return line 901.

Figure 9:
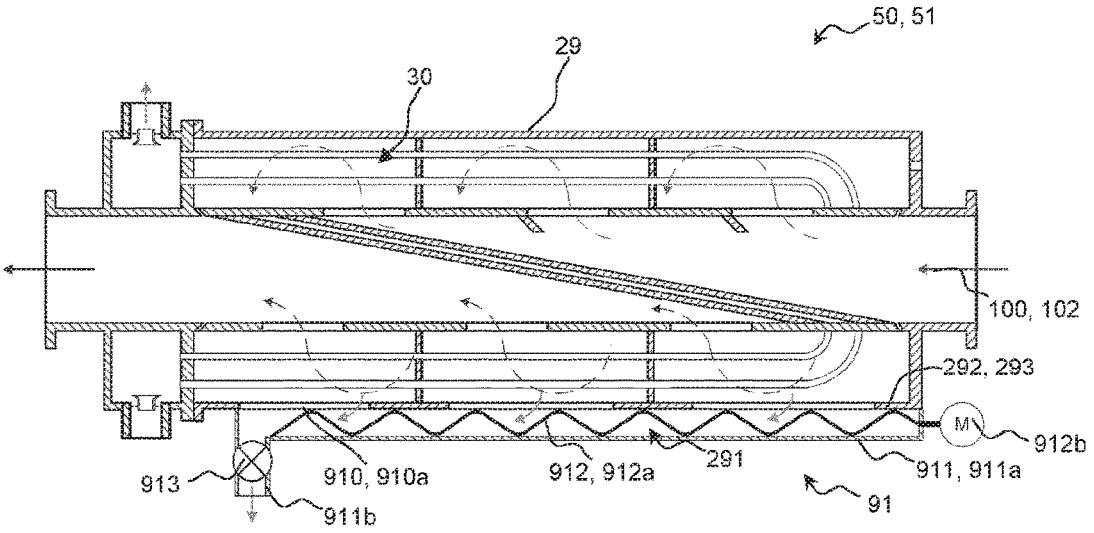
FIG. 9 shows a schematic longitudinal view of a further example flow device with an apparatus to separate and discharge particles.

FIG. 9 shows a further advantageous refinement of the flow device 50, 51 according to the examples disclosed herein, as per FIG. 3. This example is distinguished by an apparatus 91 for separating and discharging particles, which is disposed on or in the pipe jacket 29. The apparatus 91 of the illustrated example is disposed on at least one side along the guide pipe 21. In some examples, the apparatus 91 is preferably integrated in the flow device 50 or connected/coupled to the flow device 50 such that the apparatus 91 in the example of a flow device 50, 51 that is assembled so as to be operationally ready extends into a radial region 291 that is radially adjacent to the region of the pipe-bundle system 74. In some examples, particularly preferably, the apparatus 91 is disposed on or in the pipe jacket 29, respectively, such that solid materials, in particular particles, which are entrained in the radial flows 26 and/or in the circumferential flows 31 of the fluid flow 100 reach the radial region 291, for example.

In this example, a separator 910, a collection region 911, and, preferably, a conveyor unit 912, in particular a discharge worm conveyor, of the apparatus 91 are provided in the radial region 291.

The separator 910 of the illustrated example may be configured as a simple separator opening or a separator slot, and/or as a separator mesh, separator screen, and/or separator filter, which is capable of being able to separate the solid materials, in particular the particles (for example soot, crystallite, or the like) which are entrained in the fluid flow 100 or in the part-flow thereof, from the fluid which flows onward. Additionally or alternatively to the mechanical separators just mentioned, in some examples, the separator 910 may also be a separator that is based on an electric, magnetic or electromagnetic field, and which is suitable for separating the solid materials which are entrained in the fluid flow 100 or in the part-flow thereof, respectively.

According to the illustrated example, the solid materials or particles, respectively, which are separated from the fluid flow 100 by the separator 910 are collected in a collection region 911 and are optionally stored. In the simplest examples, the collection region 911 may be configured as a collection volume, a collection container, or a collection space. However, it is also conceivable for the collection region 911 to have collection or storage elements that are suitable for receiving the solid materials or particles, which are separated in the separator 910.

On particularly preferred example apparatus 91 furthermore includes a conveyor unit 912, which engages in the collection region 911, for steadily, cyclically, and/or occasionally discharging solid materials or particles, respectively, which are collected in the collection region 911, such that a continuous operation of the flow device 50, 51 is preferably also possible given a fluid flow 100 that at least temporarily is charged with solid materials, for example.

To this end, FIG. 9 shows a first preferred example of a flow device 50, 51 with an apparatus 91. The separator 910 of this example is configured as at least one radial opening 910*a* that is provided in an intermediate wall 292 or in a side wall 293 of the pipe jacket 29. In some examples, if the separator 910 is disposed in the intermediate wall 292, the collection region 911 and the conveyor unit 912 may be integrated in the intermediate space 30 in the pipe jacket 29. In the example of FIG. 9, the separator 910 is integrated in the side wall 293 of the pipe jacket 29, in particular is incorporated as a radial opening 910*a* in the side wall 293 of the pipe jacket 29. The collection region 911 of the illustrated example is formed by an add-on collection container 911*a* that covers at least the region of the separator 910, 910*a* in the side wall 293. In this example, when the fluid 100 charged with the solid materials or the particles, respectively, passes through the separator 910, 910*a* into the region having the radial flow 26, or into the circulation-flow portion 17, respectively, the particles are at least, in part, separated and held back by the add-on collection container. In some examples, the add-on collection container 911*a* may be configured as an, in particular replaceable, serviceable, and/or drainable collection container. In the case of the preferred example shown in FIG. 9, a discharge worm conveyor 912*a* is disposed in the add-on collection container 911*a*. If the discharge worm conveyor 912*a* is rotatingly moved, for example, the former conveys particles that are located in the collection region 911, 911*a* in the direction of a discharge opening 911*b* in the add-on collection container 911*a*. As a result, the collected particles are removed from the flow device 50, 51, and from the active circulation thereof, through this discharge opening 911*b*. In one example, a closure apparatus 913, such as, for example, a flap, a valve, a cellular wheel lock, or the like may be additionally provided in the discharge opening 911*b*. This closure apparatus 913, in particular during normal operation of the flow device 50, 51, serves to prevent leakage of part-amounts of the fluid flow 100 by the discharge opening 911*b*. Alternatively or additionally, in some examples, it may also be provided that the separator 910 disposes of an apparatus for controlling the engagement and/or for preventing a fluid leakage, respectively, in particular in the case of an activated conveyor unit 912. In one further example, the separator 910 may additionally be configured so as to be lockable, in particular, closure flaps being provided, for example.

The discharge worm conveyor 912*a* of the illustrated example may preferably be driven by a drive motor 912*b*. In some examples, if the drive motor 912*b* is switched and/or regulated by a suitable controller, discharging of picked-up particles may advantageously be automated. In this way, the collection region 911 may be monitored by a load sensor, for example, for a filling level to be monitored and for potential overloading to be prevented. In some examples, cyclical initiating of the discharge procedure may also be implemented to provide the discharged material in a controlled manner to a downstream process (e.g., preparing, cleaning, etc.), and also for changing loadings of the fluid flow 100.

Figure 10:
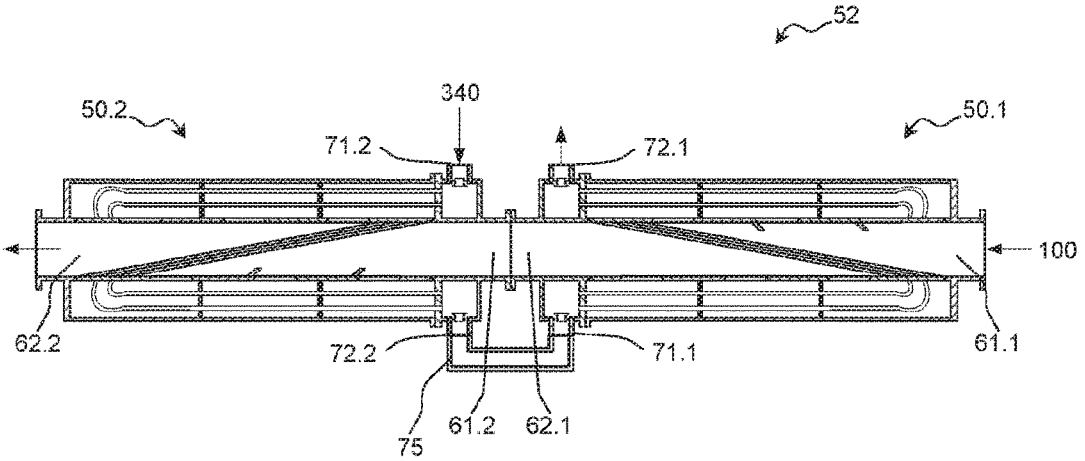
FIG. 10 shows a schematic longitudinal view of an example system with two flow devices in accordance with the teachings of this disclosure.

The example having an add-on collection container 911*a*, or the arrangement of the apparatus 91 in an add-on collection container 911*a*, as is shown as a particularly preferable example of FIG. 9, may moreover achieve a simple, advantageous retrofit of already existing flow devices 50, 51, having a pipe jacket 29 that is perfused by a fluid flow charged with particles. To this end, it may only be necessary for the pipe jacket 29 to be provided with a side wall 293 having at least one separator 910, in particular a radial screen or a radial filter 910*a*. The conveyor unit 912, as is indicated in FIG. 10, may be disposed in an add-on collection container 911*a*, where the latter is subsequently attached to the pipe jacket 29 about the separator 910. As a result, no comparatively large modification to the flow device 50, 51 per se is, thus, required.

A system 52 of two flow devices 50.1, 50.2, according to FIG. 3 and to the preceding description, is shown in FIG. 10. According to the illustrated example of FIG. 10, the flow devices 50.1, 50.2 in relation to the first line system 60.1, 60.2, are disposed to lie behind one another in a sequential manner, where the two flow devices 50.1, 50.2 are disposed to be preferably in a mutually mirrored arrangement, in particular on a plane that is perpendicular to the inflow axes and outflow axes 102.1, 103.1; 102.2, 103.2. In this example, the exit connector 62.1 of the first flow device 50.1 is preferably disposed to be substantially coaxial with the entry connector 61.2 of the second flow device 50.2 In particular, the exit connector 62.1 and the entry connector 61.2 of the illustrated example are directly interconnected such that a fluid flow 100 flowing out from the exit connector 62.1 is provided to the entry connector 6.1.2. In contrast to the example of FIG. 3, in the case of the second flow device 50.2 according to FIG. 10, the entry connector 61.2 and the exit connector 62.2 of the first line system 60.2 swap functions such that the reference in the description of the system 52 has been adapted to this reversal of functions. The second line systems 70.1, 70.2 of the example system 52 of FIG. 10 by a connection line 75 are interconnected in such a manner that fluid of the fluid flow 340, which exits from the exit connector 72.2 of the flow device 50.2, is supplied to the entry connector 71.1 of the flow device 50.1, for example. In particular, the entry connector 71.2 of the illustrated example serves as the entry connector of the second line system 70 of the system 52, while the exit connector 72.1 functions as the exit connector of the second line system 70 of the system 52.

According to the illustrated example, if a system 52 of FIG. 10 is employed as a heat exchanger, the heat transfer from the first fluid flow 100 to the second fluid flow 340, or vice-versa, respectively, arises in two steps. First, the example first fluid flow 100, which already has been pre-cooled in the first flow device 50.1, acts in the second flow device 50.2 to pre-heat an example second fluid flow 340, which is freshly supplied by the entry connector 71.2. In this example, the fluid 340 that in this way has been pre-heated in the second flow device 50.2 is then imparted a primary heating in the second heating stage in the first flow device 50.1 by a heat-transferring contact with the first fluid 100 that has been freshly supplied by the entry connector 61.1 before said fluid 340 is made available by the exit connector 72.1 of the system 52. In the course of the primary heating, the freshly supplied first fluid 100 is converted to a state of a pre-cooled fluid 100, which state in the pre-heating process still serves as a heat source, for example.

The example system 52 as shown in FIG. 10 is suitable in particular as a compact and highly efficient pre-heater/evaporator combination for a thermal power plant, in particular for an RC or an ORC plant according to the Rankine cycle, where a fluid flow 100 conducting exhaust heat may, to a large proportion, transfer the thermal energy thereof by the two aforementioned steps (pre-heating and primary heating/evaporation) to a fluid flow 100 of an operating medium, in particular of an organic operating medium, for example.

Figure 11:
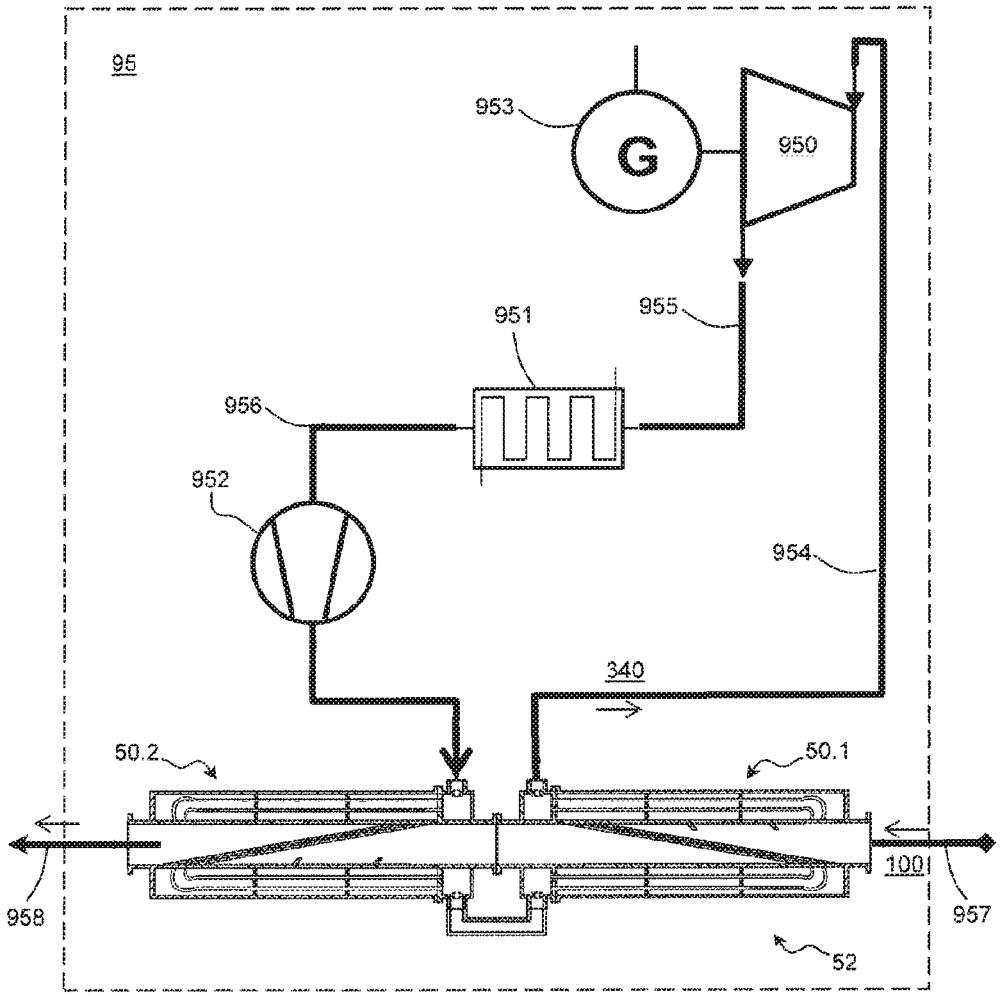
FIG. 11 shows a schematic of an ORC plant with flow devices per the example of FIG. 3 or system flow devices per the example of FIG. 10.

A basic diagram of a thermal power plant, in particular of an ORC plant 95, is shown in FIG. 11. According to the illustrated example, a multiplicity of expanded diagrams of a thermal power plant of FIG. 11 will be known to the person of ordinary skill in the art, which however may advantageously benefit to a similar extent from a flow device 50 according to the examples disclosed herein, or from a system 52 as shown in FIG. 10, respectively. Apart from a system 52 of two coupled flow devices 50.1, 50.2, the plant 95 of the illustrated example includes at least one turbine 950, one condenser 951, and one operating-means pump 952. The turbine 950 in some examples preferably drives a generator 953 to provide electrical power from the recovered thermal energy of a fluid flow 100.

In this example, the turbine 950 at the entry side is connected/coupled to a positive flow line 954 of an operating means circulation, which emanates from the exit connector 72.1 of the system 52. During operation of the plant 95 in the example system 52, a heated, preferably evaporated operating medium flows as a fluid flow 340 through the positive flow line 954 to the turbine 950. The operating medium of the fluid flow 340 is preferably almost entirely evaporated, or converted to a vapor phase or a gas phase, respectively, in the system 52, at least in one of the flow devices 50.1, 50.2 of the system 52, for example. The inflowing operating medium of the fluid flow 340 is at least partially relaxed in the turbine 950, preferably substantially relaxed, on account of the turbine 950 being driven. In this example, the relaxed operating medium, by way of a return line 955, flows to the condenser 951 in which the operating medium is cooled down to at least a condensation point, preferably, to fully condensate. However, in some examples, it may also be provided that the relaxed operating medium prior to being introduced into the condenser 951 is supplied to a recuperator (not shown in FIG. 11) to render any potentially present residual thermal energy available for other purposes. The operating medium which has condensed in the condenser 951 by the operating-means pump 952 via a supply line 956 and the entry connector 71.2 is again supplied to the system 52 based on the operating means circulation being substantially closed.

The fluid flow 100 of the illustrated example is supplied to the plant 95 by an entry connector 957, which is preferably connected directly to the entry connector 61.1 of the first flow device 50.1 of the example system 52. In this example, the freshly supplied fluid 100 is first supplied to the primary heating stage of the system 52 (e.g., the flow device 50.1), as has already been labelled in the description of the system 52 per FIG. 10 to increase and/or maximize a thermal transfer to an operating medium of the fluid flow 340 that has been pre-heated in the pre-heating stage (flow device 50.2). In this example, the fluid 100 that has been cooled in this way is then utilized in the flow device 50.2 of the system 52 as a heat source for pre-heating the fresh operating medium of the fluid flow 340, which has been provided by the supply line 956. Once the second heat transfer has been performed in the course of pre-heating in this example, the fluid 100 is then discharged from the plant again via an exit connector 958.

The flow device 50, 51 according to the examples disclosed herein, or the example system 52 of two flow devices 50.1, 50.2, 51.1, 51.2 of this type, respectively, in this way permit a particularly compact embodiment of a thermal power plant 95, which simultaneously by way of features that are easy to integrate may be adapted to special requirements (e.g., to fluid flows charged with solid materials, variable thermal outputs, etc.) without having to depart from the fundamental concept of FIG. 11. In this way, apparatuses 91 may be retrofitted or converted at any time, without the system 52 having to be completely disassembled. Also, adapting of the number of passes of the second line systems 70.1, 70.2 would be possible without any comparatively large investments, in particular if and when the manifolds 73.1, 73.2 have corresponding closure lids.

The flow devices 50, 51 of the type according to the examples disclosed herein, or systems 52 of flow devices according to the examples disclosed herein are particularly suitable for exploiting heat-conducting fluid flows 100 of incineration plants (e.g., thermal cleaning or oxidation plants, driers, thermal processing plants, furnaces, or the like), fuel cells and fuel-cell systems, in particular cooling fluid streams of high-temperature fuel cells, and other exhaust heat flows in RC or ORC plants of the type shown in an exemplary manner in FIG. 11. Apart from the example of a thermal power plant described herein, in particular an ORC plant 95, the flow device 50 according to the examples disclosed herein, or a system 52 may also be advantageously employed in chemical process engineering, in heating technology, and in other similar applications.

Figure 12A:
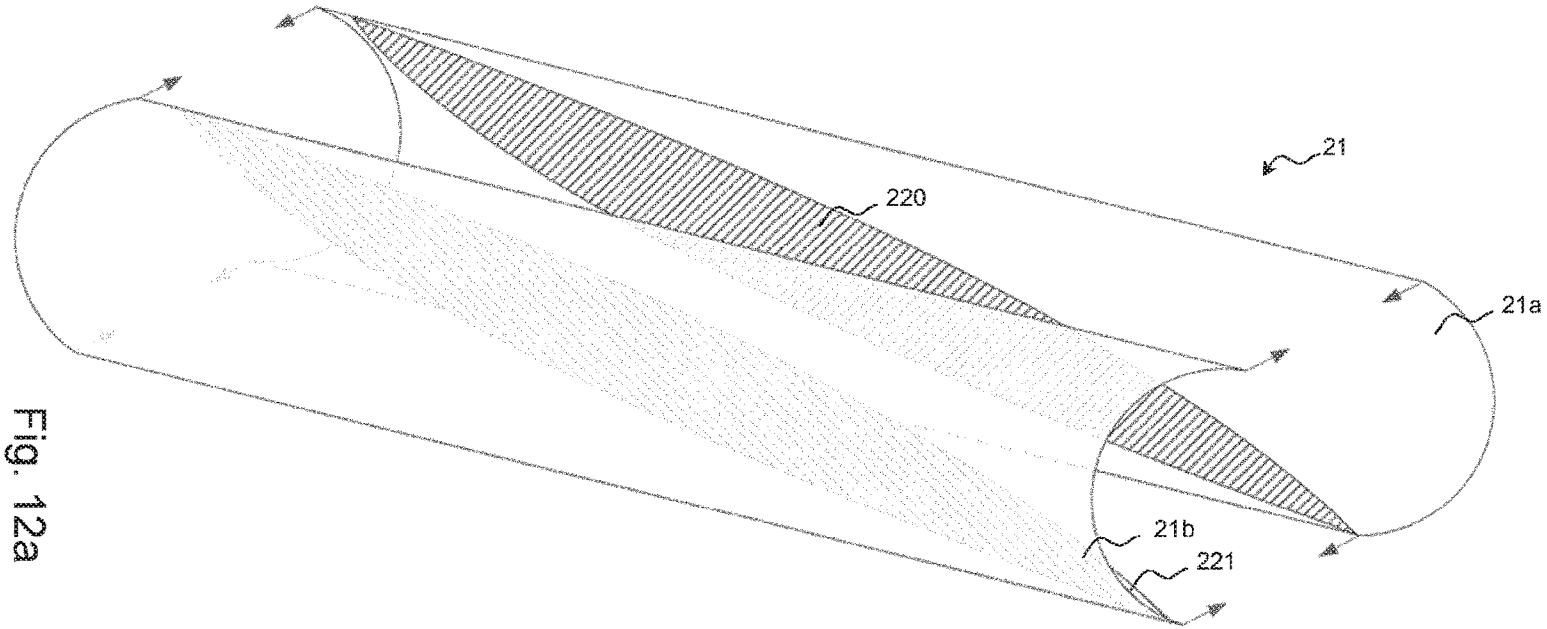
FIG. 12*a* shows a schematic view of a blank of a guide pipe for a flow device similar to the example flow device of FIG. 3.
Figure 12B:
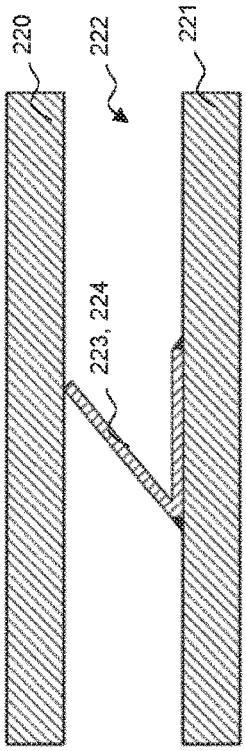
FIG. 12*b* shows a section through a partition wall in the guide pipe, after assembly.

Finally, a preferred construction of one of the core parts of the flow device 50 according to the examples disclosed herein per FIG. 3 will be discussed below. A preferred manufacturing method for a guide pipe 21 is to be described in conjunction with this example. FIG. 12*a* shows a pipe shape of the guide pipe 21. The guide pipe 21 in one preferred examples has a partition wall 22 from two wall segments 220, 221, in particular from two sheet-metal partition panels, which are intended to diagonally separate the interior of the guide pipe 21 into two regions 214, 215. The double-type embodiment of the wall segments 220, 221, or of the sheet-metal partition panels, respectively, serves for additional thermal insulation between a fluid entry and a fluid exit. According to the illustrated example, the space 222 between the wall segments 220, 221, or the sheet-metal partition panels, may either be hollow or filled with additional insulation material. To be able to reduce and/or minimize possible thermal stress between the wall segments 220, 221, or the sheet-metal partition panels, respectively, and the jacket 211 of the guide pipe 21 on the one hand, and the assembly effort on the other hand, the wall segments 220, 221, or the sheet-metal partition panels, respectively, are welded to the jacket in each case only on one side, for example. For example, welding in such examples is preferably provided on sides of the guide pipe 21 that in the assembled state are mutually opposite. For the wall segments 220, 221, or the sheet-metal partition panels, respectively, to be incorporated in the pipe blank, the guide pipe 21 of the illustrated example is centrically separated preferably in the longitudinal direction into two pipe halves 21*a*, 21*b*. In some examples, the shape of the prefabricated wall segments 220, 221, or of the sheet-metal partition panels, respectively, is preferably similar to an ellipse, a dimension of the ellipse corresponding in particular to the integral of the sectional area if the pipe blank were to be halved in the diagonal direction across the entire length thereof. One wall segment 220, 221, or one sheet-metal partition panel, respectively, is diagonally fastened, preferably welded, to the inside of each of the pipe halves 21*a*, 21*b* such that the wall segments 220, 221, or the sheet-metal partition panels, respectively, are not in contact when the pipe halves 21*a*, 21*b* are subsequently joined together, for example. According to the illustrated example, prior to the final joining together of the pipe halves 21*a*, 21*b*, a sealing tape 224 is applied, in particular welded, on top of at least one of the wall segments or of the sheet-metal partition panels, respectively, in particular across the entire length thereof. In some examples, the sealing tape 224 is embodied as a folded V-shaped sheet-metal strip, but may also be of any other suitable shape. In this example, after the pipe halves 21*a*, 21*b* have been joined together, openings in a round or a slot-shaped embodiment are incorporated in the guide pipe 21 in a radial and vertically opposite arrangement. The openings during later operation in the flow device 50 according to the examples disclosed herein function as radial passages 27, 32. However, in some examples, it may also be provided that the openings are already incorporated in the form of recesses in the pipe halves 21*a*, 21*b*, forming the openings when the latter are joined together. The openings or recesses of this example may be preferably punched, cut, or sawn out of the pipe piece. In the assembled state, the wall segments or sheet-metal partition panels, respectively, and the openings may, in particular, be disposed such in the guide pipe 21 that the inflowing fluid may leave the guide pipe 21 to be directed in a radially outward manner and, after flowing through the pipe-bundle intermediate space 30, may flow into the guide pipe 21 to be directed in a radially inward manner. Furthermore, in some examples, flow guide bodies, in particular sheet-metal deflection panels, may be disposed on, in particular welded to the openings. The guide pipe constructed in this manner may be provided for further assembly of the flow device according to the examples disclosed herein.

In summary, the following preferred features of the examples disclosed herein are to be noted. The examples disclosed herein relate to methods for guiding a fluid stream 10 that has an inflow portion 12 and an outflow portion 13 with an inflow axis 14 and an outflow axis 15, which are substantially parallel, and preferably coaxial. It is proposed in the example disclosed herein that the fluid stream 10 by way of at least one guide means 20 between the inflow region 12 and the outflow region 13 in a circulation-flow portion 17 at a circumferential angle UW circulates in a radially encircling manner about the inflow axis 14 and the outflow axis 15, where the circumference angle, UW, is greater than 0°. The examples disclosed herein furthermore relate to a flow device 50 for carrying out a method, comprising a first line system 60 for conducting a first fluid flow 100, where the first line system 60 comprises one guide pipe 21 and at least one guide means 20, 22 influencing a flow direction of the fluid flow 100 such that the fluid flow 100 between an inflow region 61*b* and an outflow region 62*b* of the first line system 60 in a circulation-flow region 105 at a circumferential angle, UW, circulates in a radially encircling manner about an inflow axis 102 and/or an outflow axis 105.

FIGS. 13*a* to 13*c* and 14 show example variants of a refinement of the flow device 50 of FIG. 3, which each additionally have a bypass installation 92. In these examples, the features that are identical or in relation to what has been described above have an equivalent effect are provided with the same reference sign in these figures.

Figure 13A:
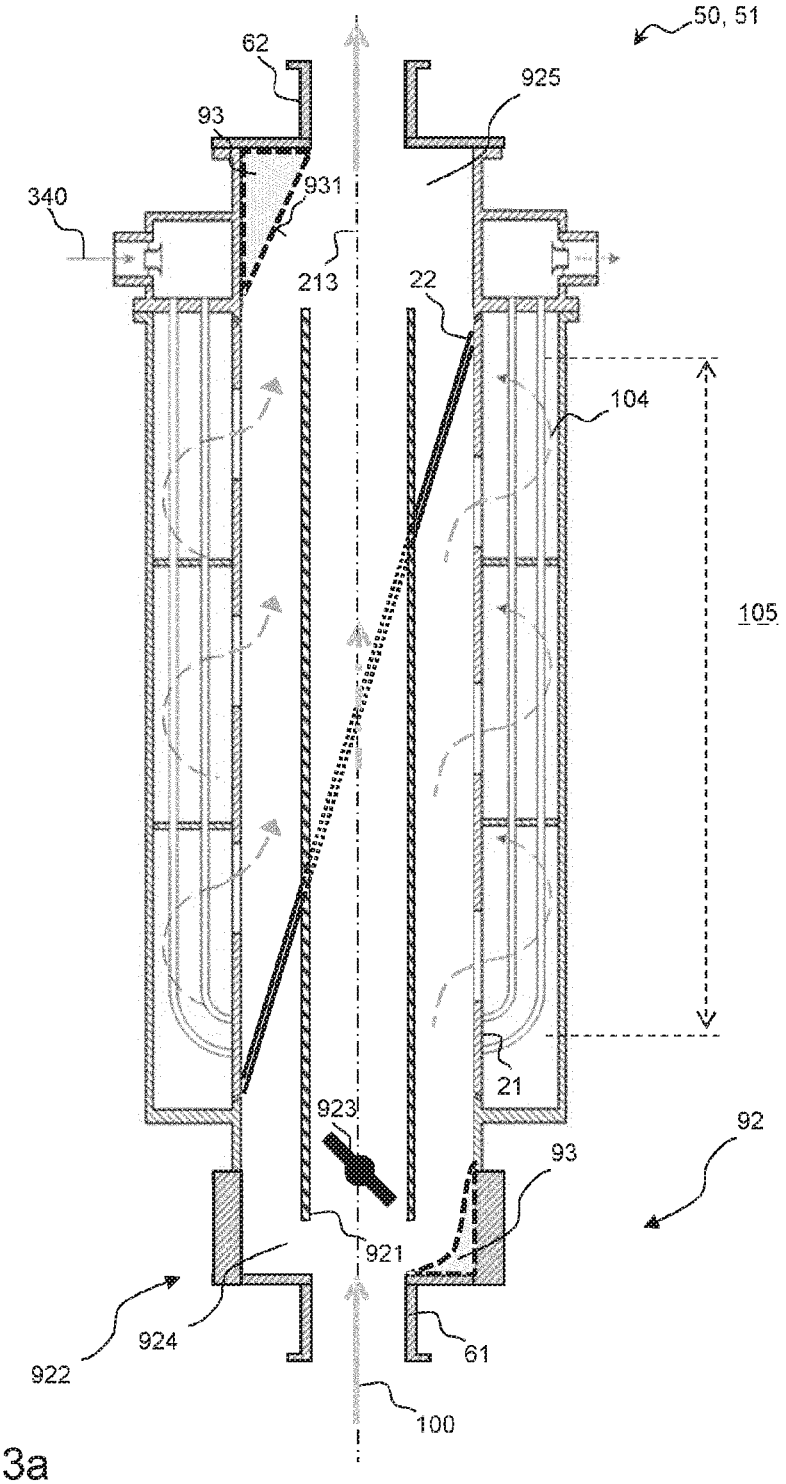
FIG. 13*a* shows a schematic longitudinal section through a refined example per FIG. 3 having a first example of a centrically disposed bypass installation.

According to the illustrated example of FIG. 13*a*, the bypass installation 92 has a bypass line 921, which as an example cylindrical pipe that extends along the main axis 213 and through the guide pipe 21 of the first line system 60. In this example, the bypass line 921 is preferably aligned so as to be coaxial with the main axis 213, in particular being configured so as to be concentric therewith. The bypass line 921 of the illustrated example penetrates or breaks through the partition wall 22 that is disposed in the guide pipe 21 such that the first fluid flow 100, which flows in by way of the entry connector 61, may flow out via the bypass line 921 in the direction of the exit connector 62 without making its way via the guide means 20, 22 into the circulation-flow region 105. In a preferred example, the bypass line 921 is configured as an insulated and, in particular, a double-walled line or pipe respectively so as to suppress or at least reduce any thermal coupling between the proportion, $A_{BP}$, of the first fluid flow 100 flowing in the bypass line 921 and the proportion $1-A_{BP}$ expanding in the guide pipe 21.

Apart from the bypass line 921, the bypass installation 92 according to FIG. 13*a* has a bypass actuator 922. The bypass actuator 922 of the illustrated example is in particular imparted the task of embodying or designing a proportion, $A_{BP}$, of the fluid flow 100 which flows out by way of the bypass line 921 of the first fluid flow 100 that flows in via the entry connector 61 to be selectable or adjustable. In this example, the proportion $A_{BP}$ may have a value between 0% and 100%, in particular between 20% and 80%, preferably between approx. 30% and 70%. The example bypass actuator 922 according to FIG. 13*a* includes at least one flap 923 and a flow divider 924, which counter to the flow direction is, instead, upstream of the flap 923. In the example of FIG. 13*a*, the entry connector 61 of the flow device 50 is disposed directly on the flow divider 924, while the flap 923 is disposed on or in the bypass line 921. The flap 923 of the illustrated example is preferably disposed in that end region of the bypass line 921 that faces the entry connector 61.

If and when the flap 923 is in the open position or, as is shown in FIG. 13*a*, in a partially open position, at least part of the inflowing fluid flow 100, corresponding to the proportion, $A_{BP}$, is discharged via the bypass line 921, where the bypass line 921 in relation to the first line system 60 has a preferably lower pressure differential, or a lower flow resistance, respectively. On account thereof, a correspondingly reduced proportion $1-A_{BP}$ is available in the circulation flow region 105 for the reciprocal action with the further fluid flow 340, for example. If the flap 923 is closed, the inflowing fluid flow 100 flows entirely through the first line system 60 and is, thus, available in its entirety in the circulation-flow region 105.

The bypass line 921 according to the examples disclosed herein as shown in FIG. 13*a* opens into a funnel-type flow collector 925 which, adjoining the circulation-flow region 105, again brings together the proportions $1-A_{BP}$ flowing via the first line system 60, and the proportions $A_{BP}$ of the first fluid flow 100, flowing via the bypass line 912 directing the same to the exit connector 62.

In this example, as is generally indicated by the dashed inserts, flow bodies 93 for optimizing a local flow profile, in particular for reducing or suppressing the formation of turbulences and/or reducing a local flow resistance may be disposed in the region of the flow divider 924, or of the flow collector 925, respectively. In some examples, deviating from the exemplary illustration of FIG. 13*a*, the flow bodies 93 are symmetrical, in particular adapted to the spatial design of the guide pipe 21 and/or of the bypass line 921, preferably adapted in a symmetrical manner thereto. In this example of the guide pipe 21, as a hollow cylinder extending along the main axis 213, the flow bodies 93 per se are configured to be cylindrically symmetrical, having a deflection face 931, which faces the flow. As a result, the deflection face 931 may have a cross-sectional profile that is substantially constant in the circumferential direction. However, it may, likewise, be advantageous for the deflection face 931 to have a cross-sectional profile that varies together with the circumferential angle. This may be advantageous in particular when the part-flows 104, which flow out of the circulation-flow region 105 are not uniformly distributed across the circumferential angle, but in particular have preferred regions across the circumferential line, for example.

Figure 13B:
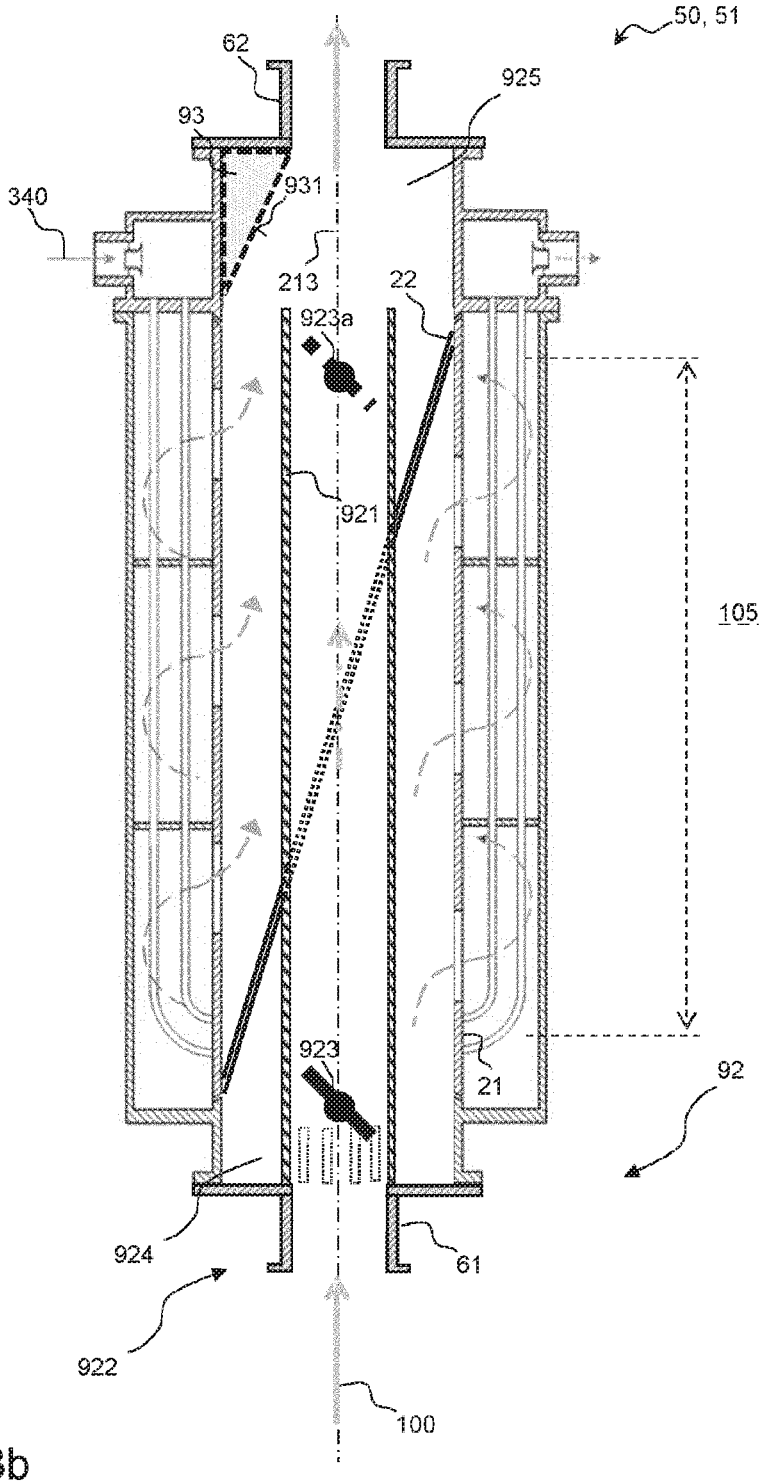
FIG. 13*b* shows a schematic longitudinal section through a refined example per FIG. 3 having a second example of a centrically disposed bypass installation.

FIG. 13*b* shows a second example variant of a flow device 50 having a bypass installation 92 which is disposed in a manner analogous to that of FIG. 13*a*. In contrast to the preceding example as shown in FIG. 13*a*, the bypass line 921 extends right up to the entry connector 61. The flow divider 924 of the illustrated example is formed by passages, in particular by slots in that end portion of the bypass line 921 that adjoins the entry connector 61. In this example, a proportion $1-A_{BP}$ of the fluid flow 100 that flows in by way of the entry connector 61 may make its way into the first line system 60, in particular into the circulation-flow region 105 through these passages.

For the proportion ABP that flows via the bypass line 921 to be adjusted, the bypass actuator 922 of the illustrated example of FIG. 13*b* has two flaps 923, 923*a*, where the flap 923 adjoins that end portion of the bypass line 921 having the passages. In this example, the second flap 923*a* is provided in an end region of the bypass line 921 that faces the exit connector 62. In this example, the second flap 923*a* serves to preclude any potential return flow from the flow collector 925 via the bypass line 921. The flow collector 925 of the illustrated example is configured in a manner analogous to that of the example of FIG. 13*a*. However, it may also be provided that the bypass line 921 in terms of the two end regions thereof is symmetrically constructed or configured such that flow dividers 924 and flow collectors 925 are constructed in a mutually analogous manner, for example.

Alternatively, in some examples, it is also conceivable that no second flap 923*a* is provided in the bypass line 921, as is the case in the example of FIG. 13*a*. Conversely, the example of FIG. 13*a* may be modified to the extent that a second flap 923*a* is provided in the bypass line 921, in a manner analogous to that of the example of FIG. 13*b*.

In terms of the effective mode with respect to the adjustment of the proportions $A_{BP}$, $1-A_{BP}$, the example of FIG. 13*b* corresponds to the embodiment of FIG. 13*a*. Should a second flap 923*a* be provided, as is shown in FIG. 13*b*, it is advantageous for the two flaps 923, 923*a* in terms of switching between a closed and an open position to be moved in a synchronized manner. However, in some examples, there may also be applications or operational states of the flow device 50, in which it is favorable for the flaps 923, 923*a* to be displaced or adjusted, respectively, in a mutually independent manner.

Figure 13C:
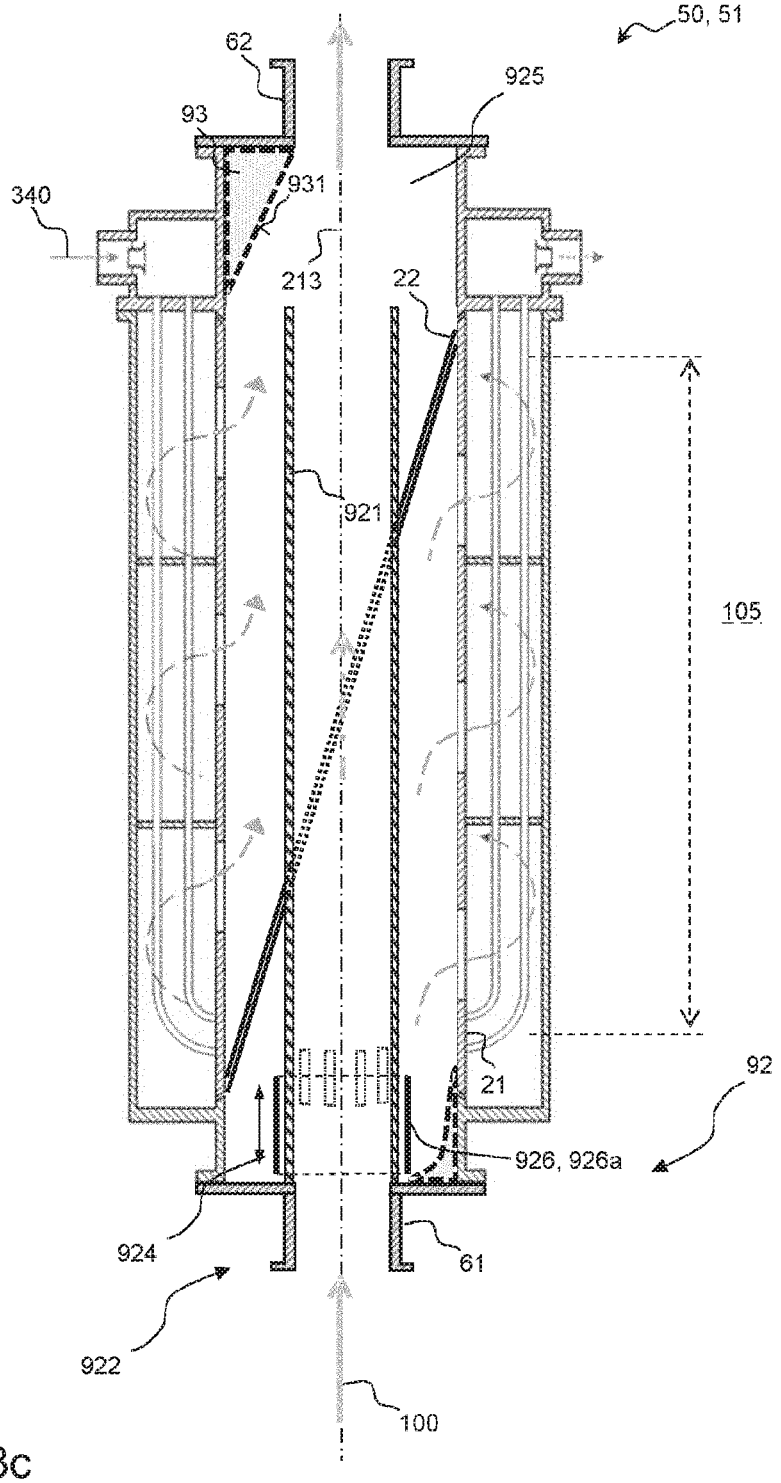
FIG. 13*c* shows a schematic longitudinal section through a refined example per FIG. 3 having a third example of a centrically disposed bypass installation.

FIG. 13*c* shows a third example variant of a flow device 50, having a bypass installation 92 which is disposed in a manner analogous to FIG. 13*a*. This example variant reverts back to the passages in the configuration of the flow divider 924 of FIG. 13*b* having the bypass line 921, where the flap 923 of the bypass actuator 922 has been replaced by a gate assembly 926.

The gate assembly 926 of the illustrated example has a sliding sleeve 926*a* that in at least one position closes off the passages, where the sliding sleeve 926*a* for switching from an open position to a closed position is axially and/or radially traversed and/or twisted. A switching characteristic for controlling or adjusting, respectively, the proportion $1-A_{BP}$ may be determined based on the number, shape, and/or placing of the passages in the bypass line 921. In principle, it is also conceivable for various passages, in particular passages that by means of a plurality of sliding sleeves 926*a* or of other closure elements which are suitable for the closure of planar passages are disposed in various manners to be provided.

Further example variants of a flow device in accordance with the teaching of this disclosure as per FIGS. 13*a* to 13*c* are derived inter alia by combining the individual features shown in the examples.

In contrast to the examples of a flow device 50 having a bypass installation 92, as are shown in an exemplary manner in FIGS. 13*a* to 13*c*, FIGS. 14*a* and 14*b* show an alternative flow device 50 having a bypass installation 92 which has an externally disposed bypass line 921. The bypass actuator 922 in the example shown in FIG. 14*a* comprises a flap 923 that is disposed in an entry-side portion of the guide pipe 21.

The bypass line 921 of the illustrated example is preferably configured or embodied as a tubular hollow body 927 that at least partially, preferably almost entirely receives and/or encloses the first line system 60, in particular the pipe jacket 29. In this example, the hollow body 927 in the example of FIG. 14*a* extends along the main axis 213, to be parallel with the guide pipe 21. In some examples, it may be provided in particular that the hollow body 927 receives or encloses the guide pipe in such a manner that the entry connector 61 and the exit connector 62 of the first line system 60 are configured as flanges that in particular are disposed on the hollow body 927 on the end side thereof.

According to the illustrated example, a funnel-type or fan-type portion of the hollow body 927, which adjoins the entry connector 61, in the present example forms the flow divider 924 of the bypass actuator 922. The entry connector 71 and the exit connector 72 of the second line system 70, which are disposed on the manifold 73 in a manner analogous to the exemplary flow device 50 of FIG. 3, are guided through the hollow body 927 such that the connectors protrude from the wall of the hollow body 927 and in the region enclosed by the hollow body jacket between the pipe jacket 29 and the internal jacket surface of the hollow body 927 may at least be partially be exposed to a circulation flow by the proportion $A_{BP}$ of the first fluid flow 100. According to this example, in the direction toward the exit connector 62, the hollow body 927 via an analogous funnel-type or fan-type portion that forms the flow collector 925 transitions into the exit connector 62.

In a complementary manner to the flap 923, an optional second flap 923*a* may additionally be disposed in an end portion of the guide pipe 21 which faces the exit connector 62, for example. In an analogous manner to the example of FIG. 13*b*, in some examples, a task of the flap 923*a* is to prevent or at least to reduce a return flow into the guide pipe 21.

In this example, the flap 923 which is disposed in the guide pipe 21 is envisaged or configured to provide a proportion $1-A_{BP}$ flowing by way of the first line system 60 in a selectively adjustable or regulatable manner. In the example of a fully opened flap 923, or in the case of fully opened flaps 923, 923*a*, the proportion $1-A_{BP}$ is increased and/or maximized while a fully closed position of the flap 923, or of the flaps 923, 923*a*, respectively, leads to the proportion $A_{BP}$ of that proportion of the first fluid flow 100 that flows out by way of the bypass line 921 to be increased and/or maximized.

Figure 14A:
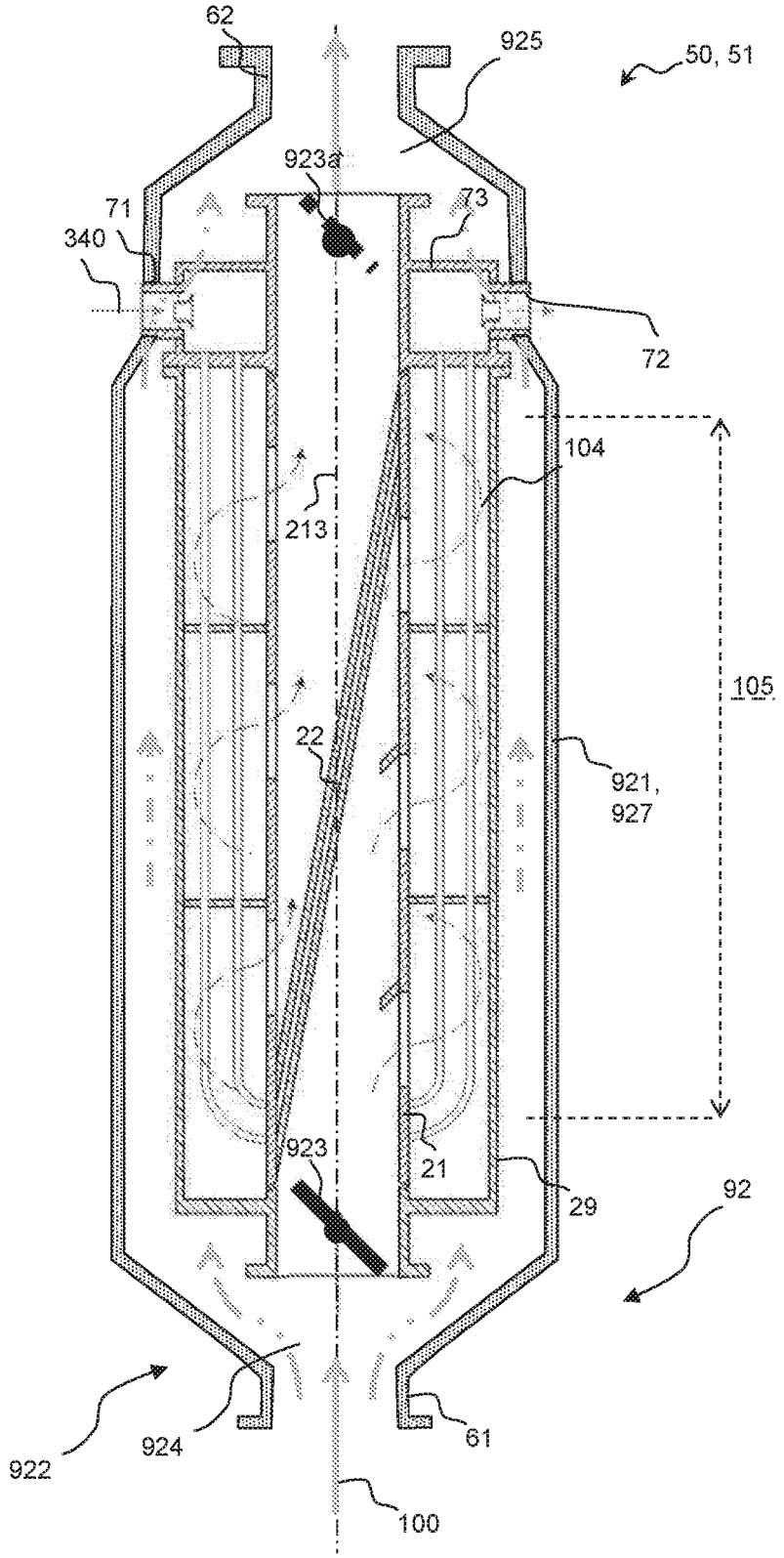
FIGS. 14*a* and 14*b* show a schematic longitudinal section through a refined example per FIG. 3 having an example of an externally disposed bypass installation.

In this example, the hollow body 927, which is provided in the example of FIG. 14*a* is preferably configured as an insulated hollow body, in particular as a double-walled hollow body, so as to preclude, but at least reduce, unfavorable heating of the external wall of the hollow body 927 in the case of an activated bypass, that is to say in the example of a substantially closed flap 923.

Figure 14B:
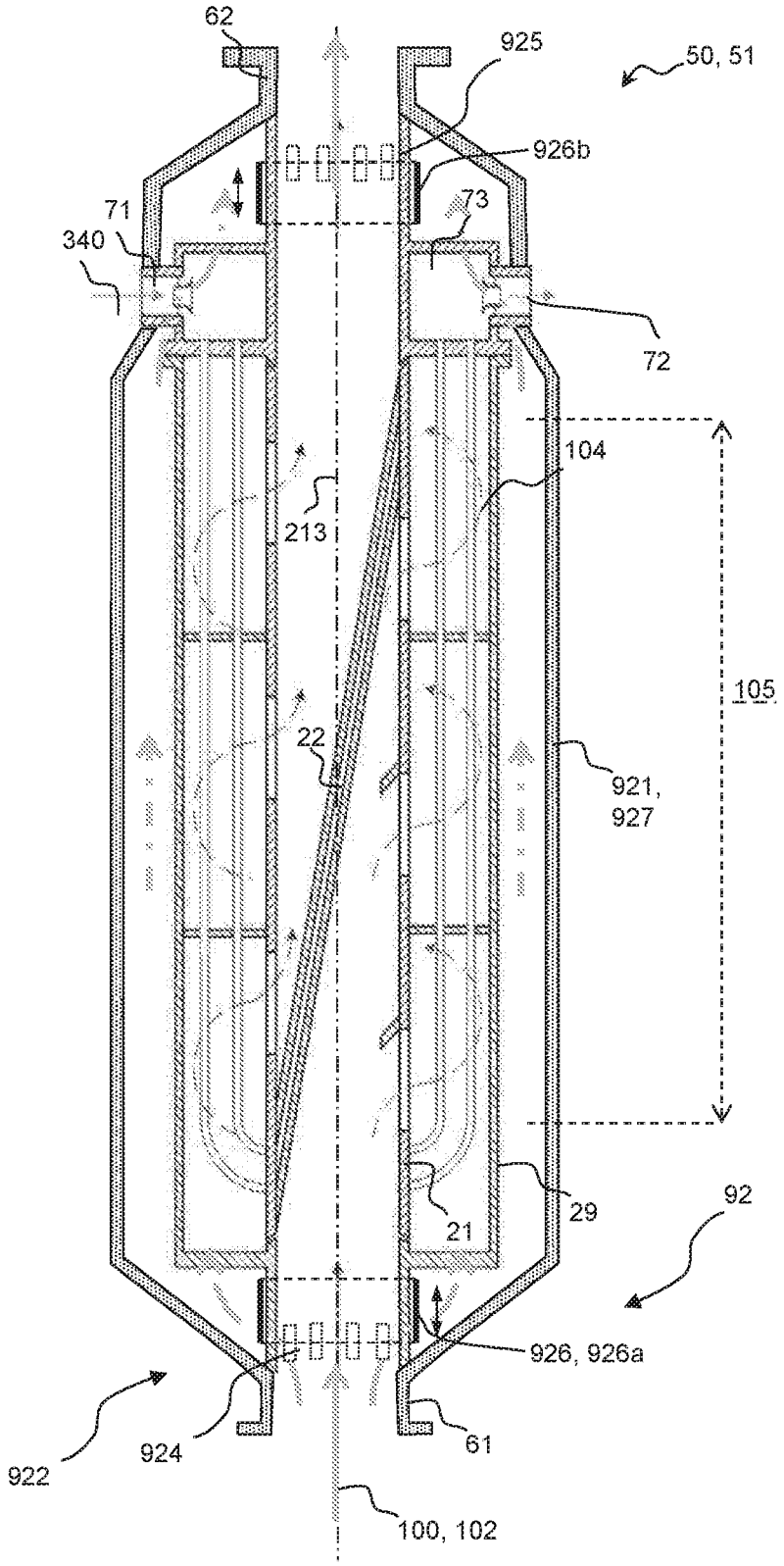

FIG. 14*b* shows a second example variant of a flow device 50 with an externally disposed bypass line 921 in the form of a hollow body 927 as shown in conjunction with the example of FIG. 14*a*, as has been described above, reference being made at this point to the description thereof with respect to the bypass line 921 or of the hollow body 927.

In contrast to the example of FIG. 14*a*, the bypass actuator 922 in the example of FIG. 13*c* is implemented in an analogous manner as a gate assembly 926. For example, the guide pipe 21 extends across the entire distance between the entry connector 61 and the exit connector 62, and in the overlapping regions is provided with the flow divider 924 and the flow collector 925 with slot-type passage, as known from FIG. 14*a*. In this illustrated example, at least those passages that are provided in the direction of the entry connector 61 by means of a gate assembly 926 are capable of selective and adjustable opening and closing. Moreover, in the example of FIG. 14*b* a second gate assembly 926*a* for opening and closing those passages that are close to the exit connector 62 is provided, where the second gate assembly 926*a* is also capable of being optionally deleted in some examples. This second gate assembly 926*a* of the illustrated example is imparted a task that is analogous to the second flap 923*a* of the examples of FIG. 13*b* or 14*a* so that reference is made to the description in this context. The gate assemblies 926, 926*a* of the illustrated example may be configured as axial gates and/or rotary gates as have already been described in the example of FIG. 13*c*.

As opposed to the embodiments of a flow device 50 per FIGS. 14*a* and 14*b*, it may also be advantageous in certain embodiments for the bypass line 921 to not be configured as an enclosing hollow body 927 but as one or a plurality of bypass ducts that extends/extends on the external wall of the pipe jacket 29, for example.

Additionally to the examples of FIGS. 13*a* to 14*b*, it may also be advantageous for the bypass actuator 922 to be able to alternatingly close the bypass line 921 and the guide pipe 21, favoring the unambiguousness of directing the flow by way of the circulation-flow portion 17 and/or the bypass. In such examples, the respective throttle positions, in particular a very effective flow cross section which is releasable or released, respectively, by the bypass actuator 922 at the entry portions of the bypass line 921 and of the guide pipe 21, are expediently inversely proportional to one another.

This patent arises as a continuation-in-part of International Patent Application No. PCT/EP2015/051960, which was filed on Jan. 30, 2015, and which claims priority to German Patent Application No. 10 2014 201 908, which was filed on Feb. 3, 2014. The foregoing International Patent Application and German Patent Application are hereby incorporated herein by reference in their entireties.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A flow device comprising:

a first line system to direct a first fluid flow having a flow direction, wherein the first line system includes a guide pipe, wherein the first fluid flow is to flow between an inflow region and an outflow region of the first line system in a circulation-flow region along a circumferential angle and circulate in a radially encircling manner about at least one of an inflow axis or an outflow axis, and wherein a first flow cross section of a portion of the guide pipe that faces towards an entry connector along the flow direction of the first fluid flow decreases at the same rate as a second flow cross section of a part of the guide pipe that faces towards an exit connector increases along the flow direction of the first fluid flow; and a second line system to direct a second fluid flow through an intermediate space surrounding the guide pipe, wherein the second fluid flow is to flow along a main flow axis of the second fluid flow that is aligned parallel with at least one of the inflow axis or the outflow axis of the first fluid flow, wherein a separation wall extends obliquely within a longitudinal cross section of the guide pipe, wherein the guide pipe is surrounded by a pipe jacket, the pipe jacket defining the intermediate space through which the second line system extends, the pipe jacket having at least one radial passage for the passage of the first fluid flow between the guide pipe and the intermediate space.

2. The flow device as defined in claim 1, wherein the at least one radial passage in relation to the circumference of the guide pipe is configured in a slotted manner.

3. The flow device as defined in claim 1, wherein the flow direction of the first fluid flow, at least on a portion of the guide pipe that points from an entry connector in the direction toward the separation wall, in a region of the at least one radial passage in which at least one flow guide body is provided.

4. The flow device as defined in claim 3, wherein a direction of circulation of part-flows in a circulation-flow portion is set by the flow guide body.

5. The flow device as defined in claim 1, wherein the separation wall separates an inflow-side region of the guide pipe, coming from an entry connector, from an outflow-side region, and going to an exit connector, wherein the separation wall is a linear flat wall that is tilted in at least one axis which is perpendicular to the main axis, or is configured to follow a two-dimensional profile that varies with an axial position along the main axis.

6. The flow device as defined in claim 5, wherein the separation wall includes a double wall, and wherein a first wall segment is coupled to the inflow-side region of a jacket or of the guide pipe while a second wall segment is coupled to the outflow-side region.

7. The flow device as defined in claim 1, wherein a flow body is disposed in at least one line system at transitions of cross sections or at deflections of flow directions.

8. The flow device as defined in claim 7, wherein the flow body includes a sleeve, wherein the former has at least one curved body for influencing a flow direction of a fluid stream that surrounds the flow body during operation, and is insertable or inserted.

9. The flow device as defined in claim 8, wherein the flow body includes a curved body for deflecting the fluid stream, and a cylinder body to arrange in line portions provided therefor, wherein the curved body is configured to be at least one of symmetrical, mirror-symmetrical or rotationally symmetrical relative to the main flow axis, or, depending on localized flow characteristics, is generally non-symmetrical.

10. The flow device as defined in claim 9, wherein the curved body, by a support structure, is coupled to the cylinder body, wherein flow-conduction properties of the curved body are configured to be variable depending on flow parameters.

11. The flow device as defined in claim 1, wherein the flow device further includes a bypass installation by which the first fluid flow at least partially adjustable via a regulatable proportion between 0 and 100% of the fluid flow to be guided past a circulation-flow portion of the first line system.

12. The flow device as defined in claim 11, wherein the bypass installation has at least one bypass line and one bypass actuator, wherein the bypass line is disposed between an entry connector and an exit connector of the first line system.

13. The flow device as defined in claim 1, wherein an apparatus to separate and discharge particles includes a separator, a collection region, and a conveyor.

14. The flow device as defined in claim 1, wherein a droplet separator that is coupled to a manifold, is received in the manifold, is integrated therein, or is disposed in the connector to the exit chamber of an exit connector, or on the exit port.

15. The flow device as defined in claim 14, wherein the condensate collected in a separation space of the droplet separator is to be provided to an entry chamber or at least to an intermediate chamber by at least one return line.

16. A system of at least two flow devices as defined in claim 1 wherein the two flow devices are sequentially interconnected, wherein an exit connector of the first line system of the first flow device is connected in a direct manner to an entry connector of the first line system of the second flow device, and wherein the exit connector of the second line system of the first flow device, by way of a connection line, is connected to the entry connector of the second line system of the second flow device.

17. A thermal power plant, having at least one flow device as defined in claim 1, wherein an operating medium is to be at least partially evaporated in the flow device by transferring heat from the first fluid flow.

18. The flow device as defined in claim 1, wherein the circumferential angle is a multiple of 30°, 45°, 60°, 90°, or 180°.

19. The flow device as defined in claim 1, wherein each of the line systems includes at least one entry connector and one exit connector for infeeding or discharging, respectively, the respective fluid flow.

20. The flow device as defined in claim 1, wherein a plurality of radial passages are provided for the passage of the first fluid flow from the guide pipe into the intermediate space, or for the passage from the intermediate space into the guide pipe, respectively, along the flow direction of the first fluid flow.

21. The flow device as defined in claim 3, wherein the at least one flow guide body extends into the guide pipe.

22. The flow device as defined in claim 8, wherein the at least one curved body includes a replaceable element in a respective piping position of the line system of the flow device.

23. The flow device as defined in claim 13, wherein the conveyor includes a discharge worm conveyor in the pipe jacket.

24. The thermal power plant as defined in claim 17, wherein the thermal power plant includes a plant for generating at least one of mechanical or electrical energy according to the Rankine cycle.

25. The thermal power plant as defined in claim 17, wherein the further fluid flow of the flow device is formed by an operating medium.

26. The thermal power plant as defined in claim 25, wherein the operating medium includes an organic operating fluid.

* * * * *